US005970290A

United States Patent [19]

Yoshiki et al.

[11] Patent Number: 5,970,290

[45] Date of Patent: Oct. 19, 1999

[54] IMAGE FORMING APPARATUS WITH TONER HOUSING CONTAINER WHICH PROMOTES EFFICIENT TONER SUPPLY

[75] Inventors: Shigeru Yoshiki, Tokyo; Hideo Yoshizawa, Urawa, both of Japan

[73] Assignee: Ricoh Company, Ltd., Tokyo, Japan

[21] Appl. No.: 09/006,048

[22] Filed: Jan. 12, 1998

[30] Foreign Application Priority Data

| | | | |
|---|---|---|---|
| Jan. 10, 1997 | [JP] | Japan | 9-003155 |
| Feb. 10, 1997 | [JP] | Japan | 9-026575 |
| Dec. 11, 1997 | [JP] | Japan | 9-341266 |

[51] Int. Cl.[6] ..... G03G 15/08

[52] U.S. Cl. ..... 399/261; 399/262

[58] Field of Search ..... 399/258, 261, 399/252, 262, 358; 222/DIG. 1

[56] References Cited

U.S. PATENT DOCUMENTS

| | | | |
|---|---|---|---|
| 4,650,312 | 3/1987 | Vineski | 399/358 |
| 4,974,023 | 11/1990 | Aimoto et al. | 399/258 X |
| 5,416,568 | 5/1995 | Yoshiki et al. . | |
| 5,455,662 | 10/1995 | Ichikawa et al. . | |
| 5,500,719 | 3/1996 | Ichikawa et al. . | |
| 5,557,382 | 9/1996 | Tatsumi et al. . | |
| 5,627,631 | 5/1997 | Ichikawa et al. . | |

FOREIGN PATENT DOCUMENTS

| | | |
|---|---|---|
| 59-129878 | 7/1984 | Japan . |
| 63-75769 | 4/1988 | Japan . |
| 7-20708 | 1/1995 | Japan . |
| 7-64384 | 3/1995 | Japan . |
| 7-140774 | 6/1995 | Japan . |
| 7-168430 | 7/1995 | Japan . |
| 8-95361 | 4/1996 | Japan . |
| 9-80883 | 3/1997 | Japan . |
| 9-106160 | 4/1997 | Japan . |
| 9-114213 | 5/1997 | Japan . |

*Primary Examiner*—Susan S. Y. Lee

*Attorney, Agent, or Firm*—Oblon, Spivak, McClelland, Maier & Neustadt, P.C.

[57] ABSTRACT

An image forming apparatus is loaded with a toner housing container which houses toner and has an opening. A lower portion of the toner housing container is knocked with rotation of the toner housing container so that toner on an interior wall of the toner housing container is moved.

80 Claims, 23 Drawing Sheets

IMAGE FORMING APPARATUS WITH TONER HOUSING CONTAINER WHICH PROMOTES EFFICIENT TONER SUPPLY

BACKGROUND OF THE INVENTION

1. Field of the Invention

The present invention relates to an image forming apparatus and a toner housing container.

2. Description of the Related Art

In electrostatic image forming apparatuses, an electrostatic latent image formed on a photosensitive body is developed with toner supplied from a developing unit and is transferred onto recording paper. After fixation, the recording paper is exhausted out of the apparatus. Since toner is consumed by such development, the consumed quantity is supplied by a toner supply unit. This toner supply unit is constituted as a portion of the image forming apparatus and has a toner housing container (toner bottle) detachably attached thereto. In an image forming apparatus such as this, if toner is consumed and the toner housing container empties, the empty container can be exchanged for a new one filled with toner.

The toner housing container is held by the toner supply unit. This toner supply unit is supported by the apparatus main body or the developing unit main body (a member which supports the toner supply unit will hereinafter be referred to as simply a main body). Under the state where the toner supply unit is held in a predetermined loading position on the main body by a stopper member, the toner supply unit supplies the toner of the toner housing container loaded in the toner supply unit to the main body.

As this toner housing container, containers having on the interior circumferential surface a spiral ridge extending from the bottom portion to the discharge opening are disclosed, for example, in Japan Laid-Open Patent Publication Nos. SHO 63-75769, HEI 7-140774, and HEI 8-95361, respectively. Each toner housing container is constructed so that it is approximately horizontally attached within the image forming apparatus and is rotated on its central axis to discharge the housed (stored) toner.

On the other hand, there is another toner supply unit as the related art of this invention which is not publicly known. This toner supply unit has a receiving bed for horizontally supporting a toner housing container. The toner housing container supported by the receiving bed is rotated by rotation means. This rotation conveys toner in the toner housing container to the discharge opening side and feeds the toner out of the toner housing container. This toner supply unit is rotated in a state in which the maximum outer-diameter portion (side surface portion) of the toner housing container is held in contact with the supporting surface of the receiving bed.

In the aforementioned cases, toner in the toner housing container is conveyed to the exit side by rotation of the toner housing container, but in the case where toner with poor fluidity is used, the quantity of toner on the interior surface of the toner housing container is increased, so there are cases where a large quantity of toner remains in the toner housing container, the conveying force is reduced, and a stable supply quantity is not obtained. Also, in the case where a toner housing container with a spiral groove formed in the interior surface is used, there are cases where this spiral groove is buried in toner, and likewise the conveying force is reduced, and a stable supply quantity is not obtained.

Japan Laid-Open Patent Publication No. HEI 8-95361 discloses a technique in which the exterior circumferential surface of a toner housing container is knocked to cause toner on an interior circumferential surface of the toner housing container to fall, thereby smoothly performing discharge of toner. In this technique, a protrusion is provided on the exterior circumferential surface, and a knocking portion urged in a direction in which the exterior circumferential surface of the toner housing container is knocked is provided in a means of holding the toner housing container. When the knocking portion rides across the protrusion, the toner housing container is knocked.

However, in this conventional technique, if the toner housing container is knocked in the state in which toner is placed on a push-out portion, toner raised up on the push-out portion will fall into the toner housing container due to vibration and therefore disadvantageously the discharge of toner will be disturbed.

SUMMARY OF THE INVENTION

It is an object of the present invention to provide an image forming apparatus and a toner housing container which are capable of reducing a quantity of toner remaining in the toner housing container, stabilizing a force of conveyance, and ensuring a stable supply quantity.

Another object of the present invention is to provide an image forming apparatus and a toner housing container which are capable of causing toner adhering to the interior circumferential surface of the toner housing container to fall and also smoothly performing discharge of toner, without disturbing discharge of toner.

To achieve the aforementioned objects, the image forming apparatus according to the present invention is constructed as follows:

(1) In an image forming apparatus loaded with a toner housing container which houses toner and has an opening, a lower portion of the toner housing container is knocked so that toner on an interior wall of the toner housing container is moved.

If constructed in this way, the lower portion of the toner housing container will be knocked and toner will be moved by the shock caused by the knocking. Since toner is present on the knocked lower portion, knock sound can be reduced.

(2) In an image forming apparatus loaded with a toner housing container which houses toner and has an opening, the toner housing container is knocked with a portion having a long surface in a direction in which toner in the toner housing container is moved, in such a manner that toner on an interior wall of the toner housing container is moved.

If constructed in this way, the toner housing container will be knocked and toner will be moved by the shock caused by the knocking. Since the knocked portion has a long surface in the longitudinal direction and also wide surfaces contact each other, knock sound can be reduced.

Such a long surface can be constituted, for example, by a bed for receiving the toner housing container. Thus, the receiving bed has a long curved surface which is opposed to the curved exterior circumferential surface of the toner housing container. If the toner housing container is knocked with such a receiving bed, it will be knocked with a long curved surface extending in the longitudinal direction of the receiving bed. Since wide surfaces contact each other, knock sound can be further reduced.

(3) In an image forming apparatus loaded with a toner housing container which houses toner and has an opening, the toner housing container is knocked at two points so that toner on an interior wall of the toner housing container is moved.

If constructed in this way, the toner housing container will be knocked at two places and therefore knock sound can be reduced.

(4) In an image forming apparatus loaded with a toner housing container which houses toner and has an opening, a member for knocking the toner housing container comprises material superior in wear-resisting property to the toner housing container, and the toner housing container is knocked with the knocking member so that toner on an interior wall of the toner housing container is moved.

If constructed in this way, the knocking member has wear-resisting property and is excellent in durability.

(5) In the image forming apparatus as set forth in the aforementioned (4), a member for knocking the toner housing container is exchangeable.

If constructed in this way, a portion badly worn can be partially exchanged. Therefore, in addition to the aforementioned advantages, the entire apparatus does not need to be formed from wear-resisting material and the service life of the entire apparatus can be prolonged.

(6) In the image forming apparatus as set forth in the aforementioned (1), (2), (3), or (4), a member for knocking the toner housing container is also a bed for receiving the toner housing container.

If constructed in this way, the receiving bed can be utilized as a knocking member. Therefore, in addition to the aforementioned advantages, toner movement can be performed without increasing the number of parts by the combined use of the functions of members.

(7) In an image forming apparatus loaded with a toner housing container which houses toner and has an opening, the toner housing container is knocked with a lever for opening or closing the opening, in such a manner that toner on an interior wall of the toner housing container is moved.

If constructed in this way, the toner housing container will be knocked by making use of the lever for opening or closing the discharge opening of the toner housing container. Therefore, toner movement can be performed without increasing the number of parts by the combined use of the functions of members.

(8) In an image forming apparatus loaded with a toner housing container which houses toner and has an opening, the toner housing container is cylindrical in shape, and a circumferential surface of the toner housing container other than circumferential surfaces in horizontal and vertical directions is knocked with a lever so that toner on an interior wall of the toner housing container is moved.

If constructed in this way, the knocked portion on the toner will be constituted by a circumferential surface portion other than circumferential surfaces in horizontal and vertical directions, so space can be saved in upward and lateral directions.

(9) In the image forming apparatus as set forth in the aforementioned (1), (2), (3), (4), (5), (6), (7), or (8), the toner housing container is cylindrical in shape and provided so that it is rotatable, and a protrusion engageable with a knocking member is provided on a circumferential surface portion of the cylindrical toner housing container which rotates.

If constructed in this way, a protrusion engageable with the knocking member can be provided on the toner housing container side. Therefore, in addition to the aforementioned advantages, the knocking mechanism can be structurally simplified.

(10) In the image forming apparatus as set forth in the aforementioned (9), the circumferential surface portion and the knocking member are in non-contact with each other, the knocking member has flexibility or elasticity, and the circumferential surface portion and the knocking member contact each other, as the toner housing container is rotated.

If constructed in this way, a knocking operation could be obtained even if the toner housing container and the knocking member were in non-contact with each other at a position other than the protrusion. Therefore, in addition to the aforementioned advantages, the load of the rotation of the toner housing container can be reduced.

(11) In the image forming apparatus as set forth in the aforementioned (9), the circumferential surface portion and the knocking member are in non-contact with each other, the toner housing container has flexibility or elasticity, and the circumferential surface portion and the knocking member contact each other, as the toner housing container is rotated.

If constructed in this way, a knocking operation could be obtained even if the toner housing container and the knocking member were in non-contact with each other at a position other than the protrusion. Therefore, in addition to the aforementioned advantages, the load of the rotation of the toner housing container can be reduced.

(12) In the image forming apparatus as set forth in the aforementioned (9), the protrusion comprises a plurality of protrusions.

If constructed in this way, a plurality of protrusions will be provided. Therefore, in addition to the aforementioned advantages, a plurality of knocking operations are obtained per one revolution and toner on the interior wall of the toner housing container can be moved with reliability.

(13) In the image forming apparatus as set forth in the aforementioned (12), the plurality of protrusions are different in length in a normal direction from each other.

If constructed in this way, a plurality of protrusions will differ in height from each other. Therefore, in addition to the aforementioned advantages, an excess of toner supply quantity can be prevented.

(14) In the image forming apparatus as set forth in the aforementioned (6), the receiving bed is slidable with respect to a main body by making use of engagement portions, and means for pressing the receiving bed is provided so that the receiving bed is pressed in one direction of a gap between the engagement portions.

If constructed in this way, press means will be provided so that the receiving bed can be pressed in one direction of the gap between the engagement portions. Therefore, in addition to the aforementioned advantages, the rattling of the receiving bed could be eliminated even if the toner housing container vibrated, and noise can be reduced.

(15) In the image forming apparatus as set forth in the aforementioned (14), the press means presses the receiving bed elastically.

If constructed in this way, the press means will be constituted by an elastic member. Therefore, in addition to the aforementioned advantages, the pressing operation can be ensured and also vibration can be absorbed by the elastic member.

(16) In a toner housing container with an opening, the toner housing container has a lower portion that is knocked, and the lower portion is knocked so that toner on an interior wall of the toner housing container is moved.

If constructed in this way, the lower portion in which toner is present will be knocked, so knock sound is low.

(17) In a toner housing container with an opening, the toner housing container has a portion with a long surface in a direction in which toner in the toner housing container is moved, and the portion is knocked so that toner on an interior wall of the toner housing container is moved.

If constructed in this way, the lower portion of the toner housing container will be knocked and toner will be moved by the shock caused by the knocking. Since the knocked portion has a long surface in the longitudinal direction and also wide surfaces contact each other, knock sound can be reduced.

(18) In a toner housing container with an opening, the toner housing container has two portions that are knocked, and the two portions are knocked so that toner on an interior wall of the toner housing container is moved.

If constructed in this way, the toner housing container will be knocked at two places and therefore knock sound can be reduced.

(19) In a toner housing container with an opening, the toner housing container has a portion that is knocked, and the portion is inferior in wear-resisting property to a knocking member and knocked so that toner on an interior wall of the toner housing container is moved.

If constructed in this way, the material of a portion to be knocked will be inferior in wear-resisting property to that of the knocking member and therefore the life of the knocking member can be prolonged.

(20) In a toner housing container with an opening, the toner housing container has a portion that is knocked by a lever for opening or closing the opening, and the portion is knocked with the lever so that toner on an interior wall of the toner housing container is moved.

If constructed in this way, a toner housing container capable of eliminating toner stagnation can be provided.

(21) In a toner housing container with an opening, the toner housing container which is cylindrical in shape and has a portion that is knocked at a circumferential surface other than circumferential surfaces in horizontal and vertical directions, and the portion is knocked so that toner on an interior wall of the toner housing container is moved.

If constructed in this way, the space efficiency of the apparatus can be enhanced.

The above and other objects and advantages of the present invention will become apparent from the following detailed description of the preferred embodiments of the invention when read in conjunction with the accompanying drawings.

BRIEF DESCRIPTION OF THE DRAWINGS

FIG. 2(*b*) is a front view of the toner housing container rotated 90° in the circumferential direction thereof from the position shown in FIG. 2(*a*);

FIG. 2(*c*) is a left side view showing the bottom portion of the toner housing container shown in FIG. 2(*b*);

FIG. 5(*b*) is a view similar to FIG. 5(*a*) showing the state immediately before the protrusion falls in the recess;

FIG. 7(*b*) is a front view of the drive motor;

FIG. 11(*b*) is a cross sectional view showing the toner housing container taken substantially along line IV—IV of FIG. 9, a toner fall position having been positioned downward from the position of FIG. 11(*a*);

FIG. 11(*c*) is a cross sectional view showing the toner housing container taken substantially along line IV—IV of FIG. 9, a toner rise preparation position having been positioned downward from the position of FIG. 11(*a*);

DETAILED DESCRIPTION OF THE PREFERRED EMBODIMENTS

An image forming apparatus and a toner housing container according to an embodiment of the present invention will hereinafter be described in detail in reference to the drawings.

(First Embodiment)

Figure 2A:
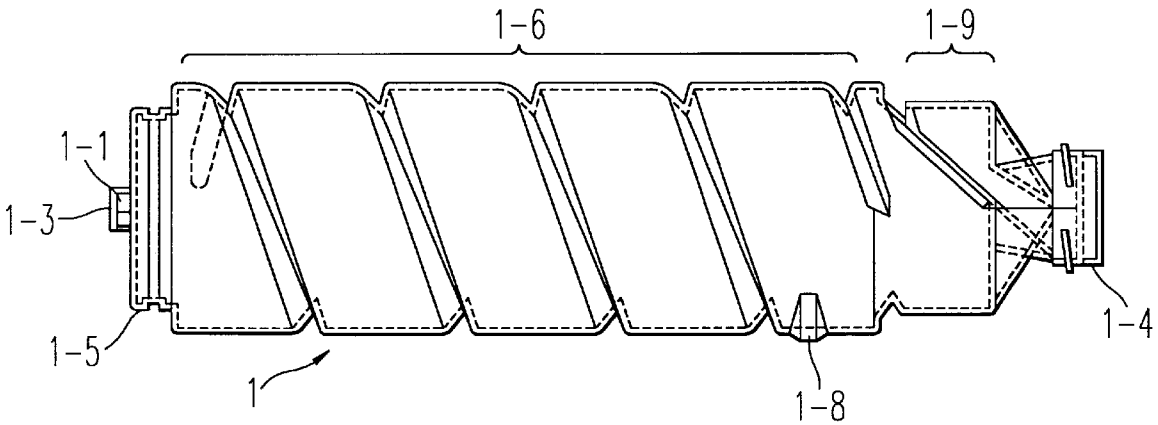
FIG. 2(*a*) is a front view of the toner housing container show in FIG. 1.
Figure 2B:
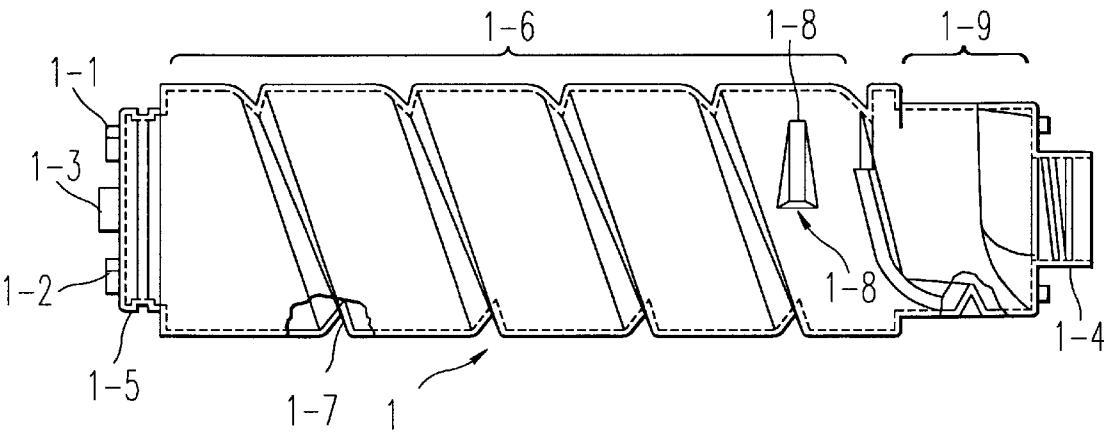
Figure 2C:
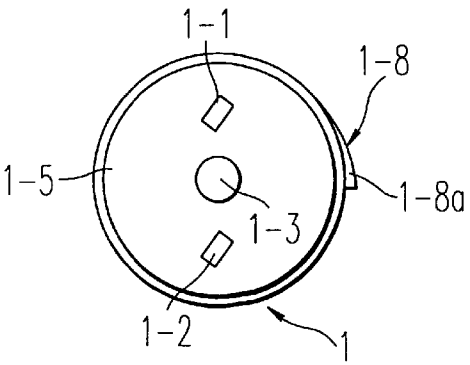
Figure 3:
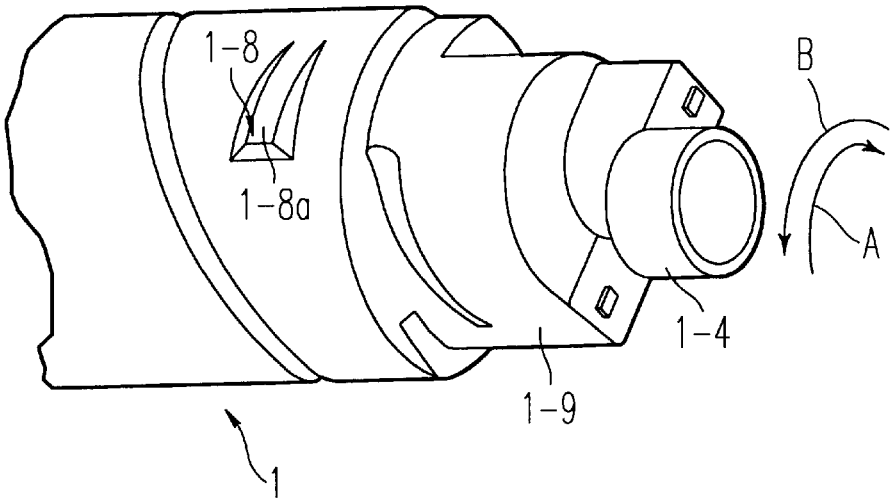
FIG. 3 is a perspective view showing the discharge opening of the toner housing container in FIG. 1.

FIGS. 2 and 3 show a toner housing container 1 that is employed in a first embodiment of the present invention. FIG. 2(*a*) is a front view of the toner housing container 1, FIG. 2(*b*) is a front view of the toner housing container 1 rotated 90° in the circumferential direction thereof from the position shown in FIG. 2(*a*), and FIG. 2(*c*) is a left side view showing the bottom portion of the toner housing container 1 shown in FIG. 2(*b*). FIG. 3 is a perspective view showing the essential portion of the toner housing container 1.

In these figures the toner housing container 1 is generally cylindrical in shape. On the exterior surface of a bottom portion 1-5 which is one end in the longitudinal direction of the housing container 1, are provided outer protruding portions 1-1 and 1-2 and a center protruding portion 1-3. The outer protruding portions 1-1 and 1-2 engage a portion of rotation means to be described later and give rotation to the toner housing container 1, while the center protruding portion 1-3 centers the center of rotation.

The end portion opposite the bottom portion 1-5 is formed into a small-diameter portion. The small-diameter portion is formed with an opening, which in turn constitutes a discharge portion (exit portion) 1-4 for discharging toner. The greater part of the portion between the bottom portion 1-5 and the discharge portion 1-4 constitutes a large-diameter exterior circumferential surface portion 1-6 which becomes the maximum outer diameter of the toner housing container 1. In this toner housing container 1, a spiral groove 1-7 is formed in the interior circumferential surface portion extending from the bottom portion 1-5 through the large-diameter exterior circumferential surface portion 1-6 to the discharge portion 1-4. If the toner housing container 1 with toner is rotated in a predetermined rotational direction, then toner will be fed from the bottom portion 1-5 to the discharge portion 1-4.

In the first embodiment, the large-diameter exterior circumferential surface portion 1-6 is formed with a protrusion 1-8 on a side near the discharge portion 1-4. If it is assumed that the toner housing container 1 rotates in a rotational direction A, the protrusion 1-8 has a gradient surface 1-8*a* which becomes gradually higher than the exterior circumferential surface portion as it advances in a direction B opposite the rotational direction A, as shown in FIG. 3. This gradient surface 1-8*a* has an external form which suddenly falls on the level of the exterior circumferential surface portion, as it advances in the direction B. The longitudinal section is in a generally wedged shape, as shown in FIG. 2(*c*).

Now, a toner supply unit 6 will be described in detail based on FIGS. 1 and 4.

Figure 1:
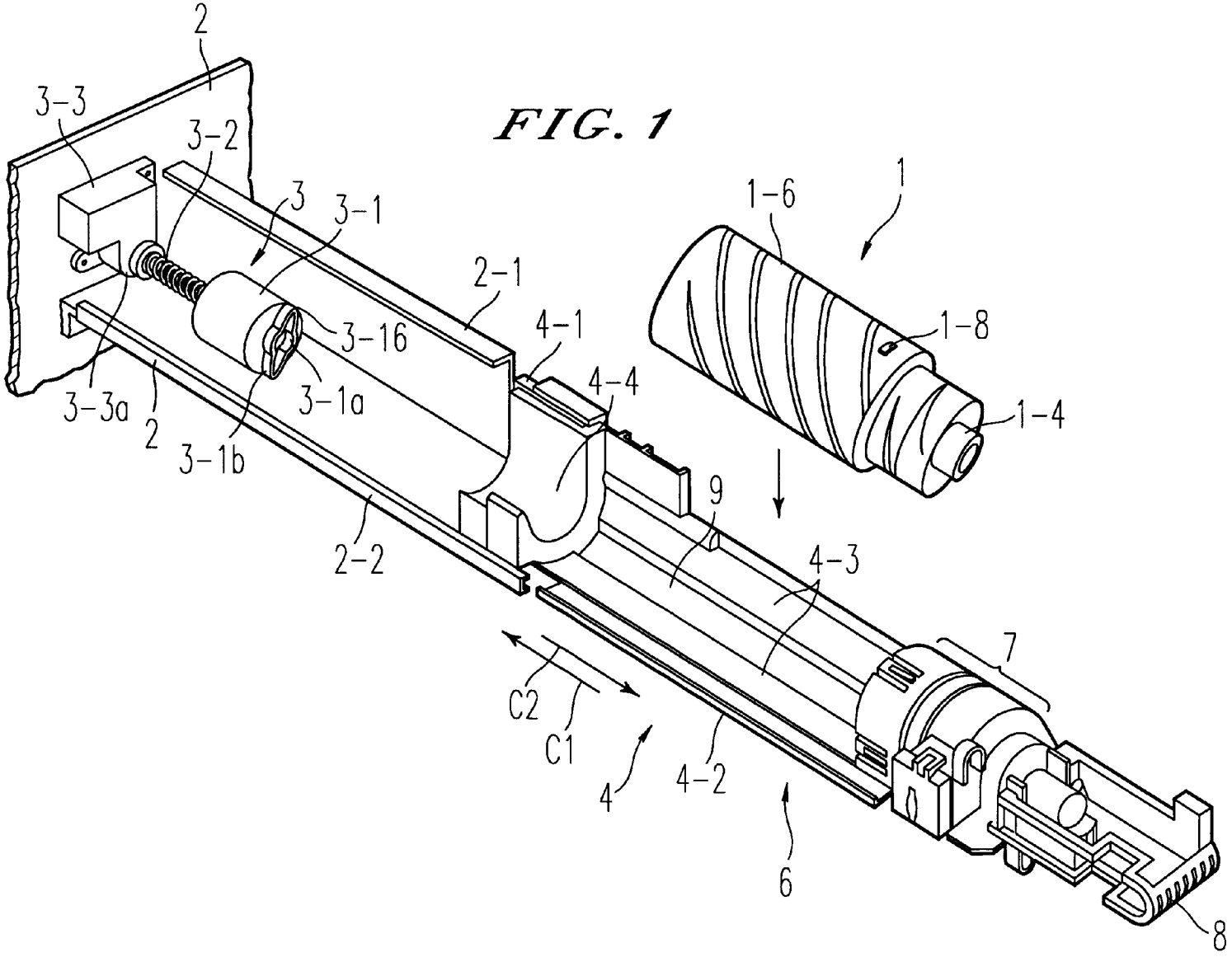
FIG. 1 is a perspective view of a toner supply unit and a toner housing container according to a first embodiment of the present invention.

FIG. 1 shows the state in which a bed 4 for receiving the toner housing container 1 has been pulled out from a main body 2 in one sliding direction indicated by arrow c2. The receiving bed 4 constitutes part of the toner supply unit 6. FIG. 4 shows the state in which the receiving bed 4 has been inserted into the main body 2 in the other sliding direction indicated by arrow c1.

The toner housing container 1 is rotated by rotation means 3 provided on the side of the main body 2. This rotation means 3 is roughly constituted by a joint 3-1, a spring 3-2, and a drive motor 3-3. The end face of the joint 3-1, as shown in FIG. 1, is formed with a recess 3-1*a* into which is inserted the center protruding portion 1-3 of the toner housing container 1 and also is formed with protruding portions 3-1*b* which engage the outer protruding portions 1-1 and 1-2 of the toner housing container 1.

The receiving bed 4 is provided with engagement portions 4-1 and 4-2, which in turn mechanically engage guide rails 2-1 and 2-2 formed in the main body 2. Thus, the receiving bed 4 is slidable in the directions of arrows c1 and c2. When the toner housing container 1 is removed from the toner supply unit 6, the removal is performed in the state in which the receiving bed 4 has been pulled out in the direction c2, as shown in FIG. 1.

The receiving bed 4 has a surface 4-3 for receiving the toner housing container 1. The receiving surface 4-3 is formed into a curved surface having nearly the same curvature as the exterior circumferential surface of the toner housing container 1. The toner housing container 1 with toner is placed on the receiving surface 4-3 so that the bottom portion 1-5 is directed toward the side of the rotation means 3.

Then, if the receiving bed 4 is pushed in the insertion direction c1 with a knob 8, the discharge portion 1-4 of the toner housing container 1 will abut a portion of a toner receiving portion 7, and the bottom portion 1-5 of the toner housing container 1 will abut the joint 3-1 of the rotation means 3. If the receiving bed 4 is further pushed in the insertion direction c1, the spring 3-2 will be compressed and the receiving bed 4 will be positioned and held by a holding means (not shown) at a position at which the center protruding portion 1-3 of the toner housing container 1 is fitted into the recess 3-1*a* of the rotation means 3. At this time, the toner housing container 1 is held between the joint 3-1 and the toner receiving portion 7, and the large-diameter exterior circumferential surface portion 1-6 is contacted with the receiving surface 4-3 of the receiving bed 4 by the dead weight of the toner housing container 1.

Describing further about the held state of the toner housing container 1 in the toner receiving portion 7, in FIGS. 2 and 3, an intermediate portion 1-9 slightly smaller than the largest-diameter portion of the toner housing container 1 is fitted into a cylinder-shaped body (not shown) of the toner receiving portion 7, and the discharge portion 1-4 is fitted into and held by a cylindrical body within the toner receiving portion 7.

Figure 4:
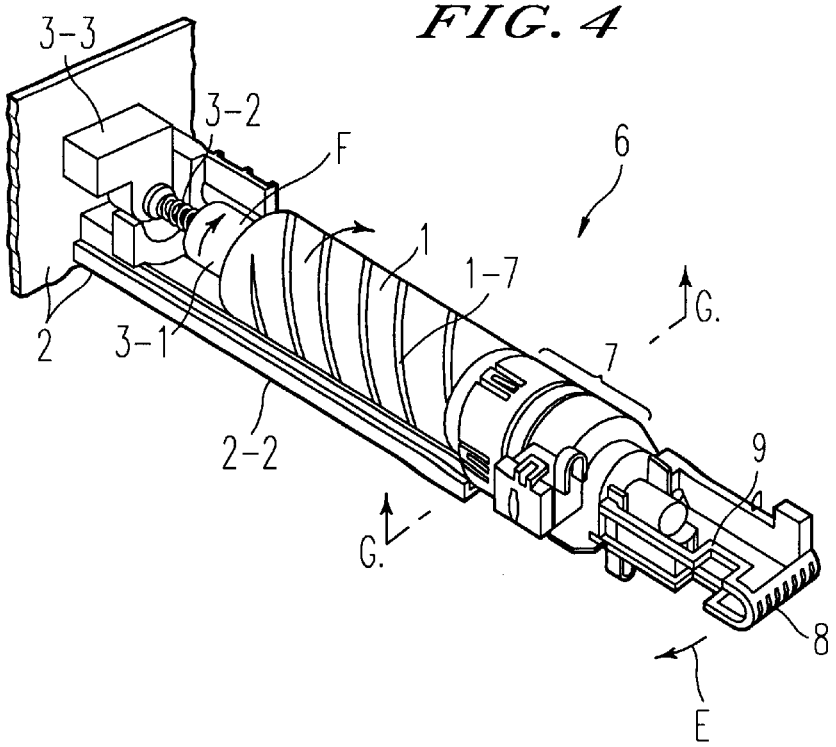
FIG. 4 is a perspective view showing the toner supply unit loaded with the toner housing container according to the first embodiment of the present invention.

In FIG. 4, if a grip 8 is tilted in a direction of arrow E, a cap (not shown) closing the discharge portion 1-4 of the toner housing container 1 will automatically be pulled out in interlock with the tilting operation by the internal mechanism of the toner receiving portion 7. If the drive motor 3-3 is driven based on a toner supply command, the joint 3-1 will rotate in a direction of arrow F. This direction of arrow F is one in which toner is fed toward the discharge portion 1-4 along the spiral groove 1-7. If the joint 3-1 rotates, the protruding portion 3-1*b* will abut the protruding portion 1-1 and/or the protruding portion 1-2 and rotate the toner housing container 1 in the direction of arrow E. This rotation causes the toner within the toner housing container 1 to be fed toward the discharge portion 1-4 and to a developing portion of an image forming apparatus via the toner receiving portion 7.

If the toner housing container 1 empties, it will be exchanged based on a warning that the container 1 is empty. The procedure for performing this exchange is the reverse of the aforementioned procedure for loading the toner housing container 1 into the main body 2.

Figure 5B:
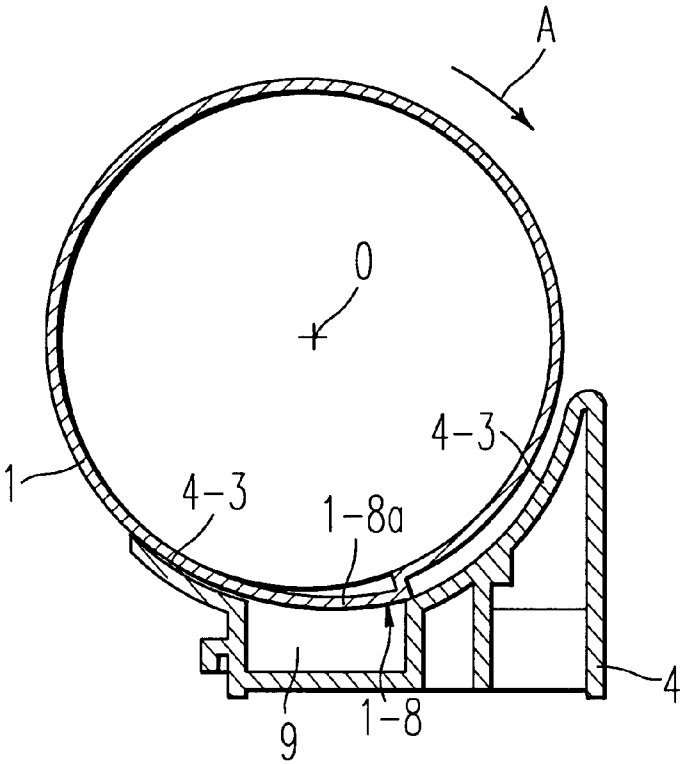
FIG. 5(*a*) is a cross sectional view of the toner housing container taken substantially along line G—G of FIG. 4, the protrusion of the toner housing container having fallen in a recess formed in a receiving bed.
Figure 5A:
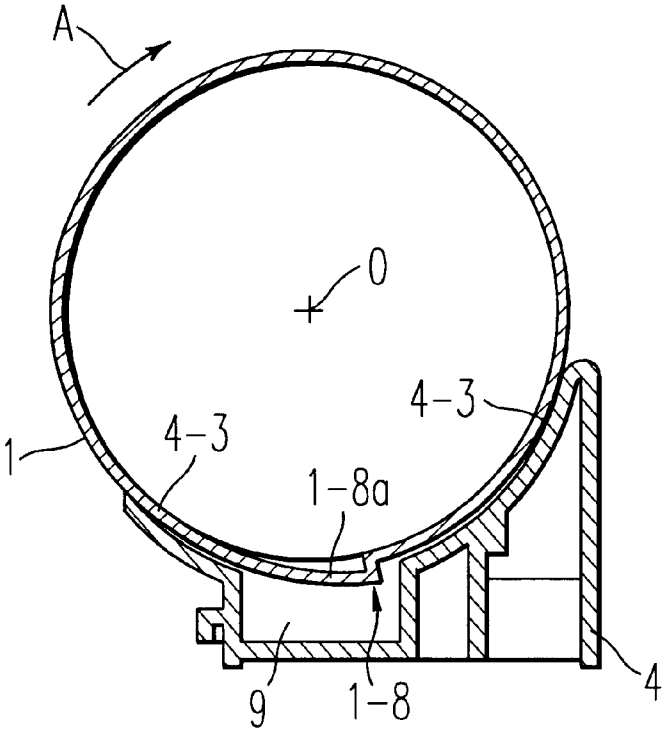

FIGS. 5(*a*) and 5(*b*) show cross sectional views of the toner housing container 1 loaded in the toner supply unit 6 in FIG. 4 taken substantially along line G—G of FIG. 4. The receiving surface 4-3 is formed with a recess 9. This recess 9 is sized so that the protrusion 1-8 of the toner housing container 1 can completely fall in over the longitudinal direction of the central axis of the toner housing container 1. At this time, the toner housing container 1 is in a state held by the joint 3-1 and the toner receiving portion 7 by operation of the grip 8, and this recess 9 is formed in the receiving surface 4-3 of the receiving bed 4 so that it is positioned just under the central axis of the toner housing container 1.

With such constitution, as shown in FIG. 5, if the joint 3-1 is rotated in the direction of arrow A by the driving force of the drive motor 3-3, the protrusion 1-8 will alternately repeat a state (FIG. 5(*a*)) in which it falls in the recess 9 and a state (FIG. 5(*b*)) in which it rides from the recess 9 on the receiving surface 4-4 and rotates while sliding. When the protrusion 1-8 falls in the recess 9, the lower portion of the toner housing container 1 (where toner is present) is knocked with the receiving surfaces 4-3 formed across the recess 9, and shock is given to the toner housing container 1. With this shock, the toner adhering to the interior wall of the toner housing container 1 is separated from the wall and therefore has fluidity. As a consequence, the separated toner is fed toward the discharge opening 1-4, as the toner housing container 1 is rotated.

In order to obtain a large shock effect by a sudden fall and smoothly ride on from the recess 9, the protrusion 1-8 of the toner housing container 1 has a generally wedged external form which falls on the level of the exterior circumferential surface portion of toner housing container 1 suddenly through the gradient surface 1-8*a* which becomes gradually higher than the exterior circumferential surface portion as it advances in the direction of arrow B opposite the rotational direction A, as shown in FIG. 3. For this reason, the toner housing container I rotates smoothly without catching the protrusion 1-8 of the container 1 on the receiving surface 4-3 even when it rides on the protrusion 1-8, so there is no possibility that the driving torque of the toner housing container will be excessive, and the use of the drive motor 3-3 having the same torque as the conventional constitution becomes possible.

Note that if the protrusion 1-8 rides on the receiving surface 4-3, position fluctuation will occur in the toner housing container 1 before and after riding on the surface. Because of this, on the side of the bottom portion 1-5 of the toner housing container 1 and in the holding portion (which is a connecting portion between the toner housing container 1 and the toner supply unit 6 and is constituted by the discharge portion 1-4 and the toner receiving portion 7) on the side of the discharge portion 1-4, there is the fear that excessive force will act. However, in that respect, the respective engaged portions have room so that excessive force does not act, and consequently, there is no problem.

Also, as in this embodiment, in the case where the protrusion 1-8 is provided on the side of the discharge portion 1-4, toner conveyed from the bottom portion 1-5 is condensed and crumbled near the discharge portion 1-4 (discharge opening), so toner can be effectively exhausted from the discharge portion 1-4 (discharge opening).

On the other hand, as a variation of the first embodiment, in the case where the protrusion 1-8 is provided on the side of the bottom portion 1-5 of the toner housing container 1, sealing performance is effectively ensured at the portion where engagement between the toner receiving portion 7 (holding portion) and the toner housing container 1 is performed. That is, in a place where engagement is performed, sealing performance is ensured with material such as rubber, but in the case where the protrusion 1-8 is provided on the side of the bottom portion 1-5, there is a distance from the aforementioned holding portion serving as a fulcrum, so the amplitude of vibration by the protrusion 1-8 is reduced on the bottom portion side on which the protrusion 1-8 is provided. With this, the leakage of toner from the engaged portions in the holding portion can be reduced.

As previously described, the protrusion 1-8 slides on and along the receiving surface 4-3 of the receiving bed 4 which is a member for knocking the toner housing container 1, as the toner housing container 1 is rotated. For this reason, it is believed that the protrusion 1-8 and the receiving surface 4-3 are worn with the passage of time. Hence, in the receiving surface 4-3, preferably a portion which is contacted by the protrusion 1-8 is constituted by wear-resisting material. As a means for achieving this, the receiving bed 4 may be partially different in material, or the whole of the receiving bed 4 may be constituted by wear-resisting material.

In the case where manufacturing the whole of the receiving bed 4 with wear-resisting material is difficult from the cost side or problems on manufacture, a portion of the receiving bed 4 may have a wear-resisting property and preferably that portion is provided with an exchangeable member. If constructed in this way, when a portion of the receiving bed is worn considerably and caused to be in a state which cannot give an appropriate shock force to the toner housing container 1, this portion can be exchanged.

Figure 6:
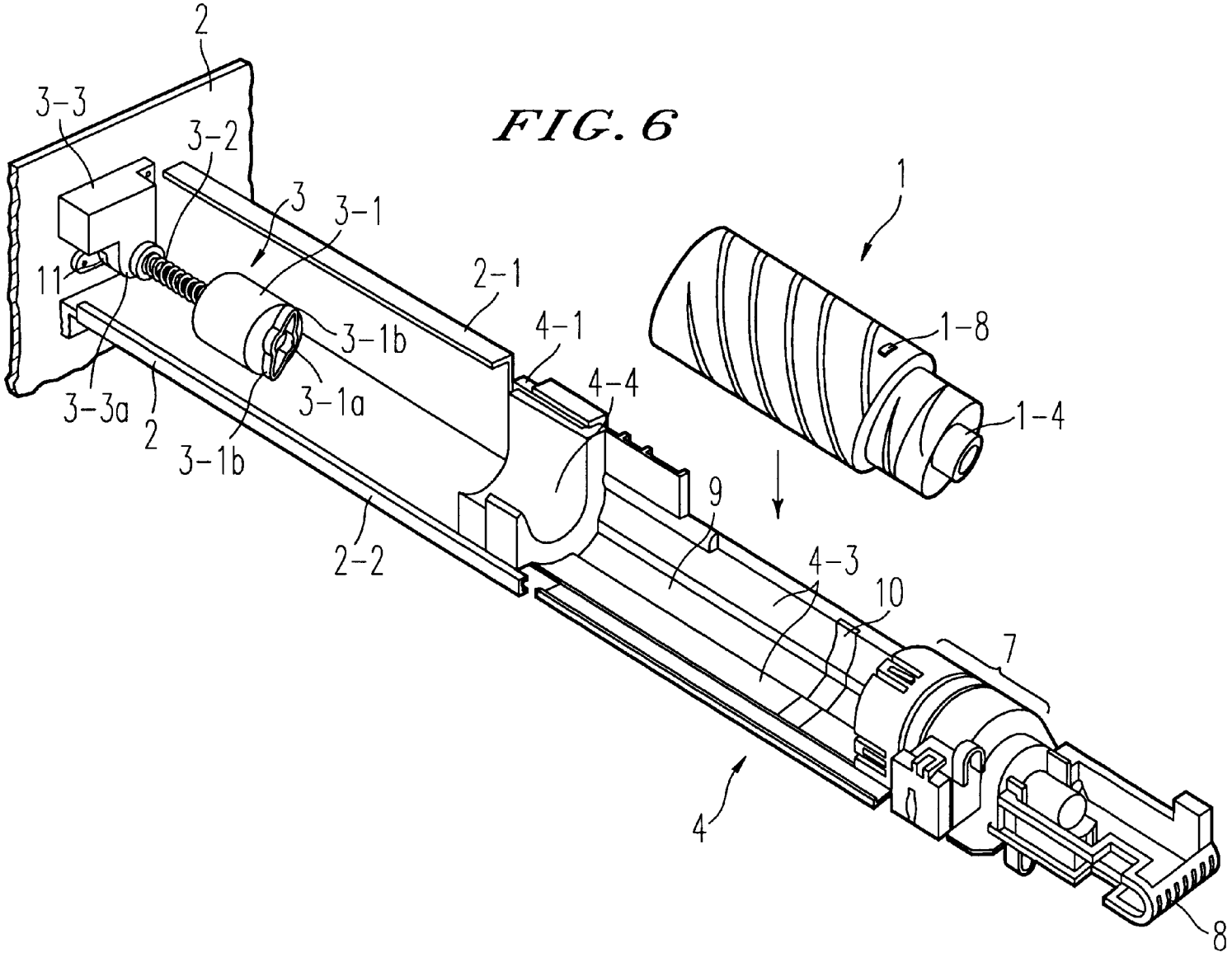
FIG. 6 is a perspective view of a toner supply unit according to a variation of the first embodiment.

In FIG. 6, when acrylonitrile-butadiene-styren (ABS) resin is used as the material of the receiving bed 4, a recess with suitable width and depth is formed in the portion of the receiving bed which is contacted by the protrusion 1-8, and an exchangeable member 10 consisting of polyacetal is buried in the recess and fixed by screws. Since polyacetal is excellent in wear-resisting property, the portion contacted by the protrusion 1-8 is not worn over a long time. This constitution can give shock to the toner housing container 1 and have a toner unbinding (separating) effect. In addition, in the case where the exchangeable member 10 has been worn, it can be easily exchanged for a new one.

As a variation of the exchangeable member 10 shown in FIG. 6, instead of the exchangeable member 10 a polyethylene terephthalate (PET) film can be provided without providing the aforementioned recess. At this time, it is a convenience to employ an exchangeable member with double-faced tape in the back surface of the PET film. The PET film is attached to a predetermined portion on the receiving bed 4 by double-faced tape. In this case, even in the case where the PET film has been worn, it can be easily exchanged only by peeling off double-faced tape, and the life of the toner supply unit can be prolonged. Furthermore, even when the apparatus main body is withdrawn, the reuse of the toner supply unit becomes possible by simple operation.

As previously described, in the state in which the receiving bed 4 has been pulled out on one side of the sliding directions, as shown in FIG. 1, the toner housing container 1 is exchanged, and in the state in which the receiving bed 4 has been pushed into the main body on the other side by making use of the engagement between the guide rails 2-1 and 2-2 and the engagement portions 4-1 and 4-2, as shown in FIG. 4, toner is supplied by rotation of the toner housing container 1. Since movement of the receiving bed 4 is performed by the engagement between the guide rails 2-1 and 2-2 and the engagement portions 4-1 and 4-2, a gap is always required between them in order to make the movement of the receiving bed 4 possible, and actually a gap has been provided. However, if this gap is present, noise will be developed by the rattling of the gap portion when the protrusion 1-8 falls in the recess 9. This variation is related to a means for eliminating the occurrence of such noise.

The front end portion (4-4) of the receiving bed 4 and the drive motor 3-3 are previously formed into predetermined shapes so that they can engage each other when the receiving bed 4 is loaded into the main body 2, as shown in FIG. 4. FIG. 1 shows the state in which the receiving bed 4 has been pulled out from the main body 2. In FIG. 1, the front end portion of the receiving bed 4 constitutes a concave curved portion 4-4, and the drive motor 3- 3 which engages the concave curved portion 4 -4 constitutes a convex curved surface portion 3-3*a*.

Figure 7B:
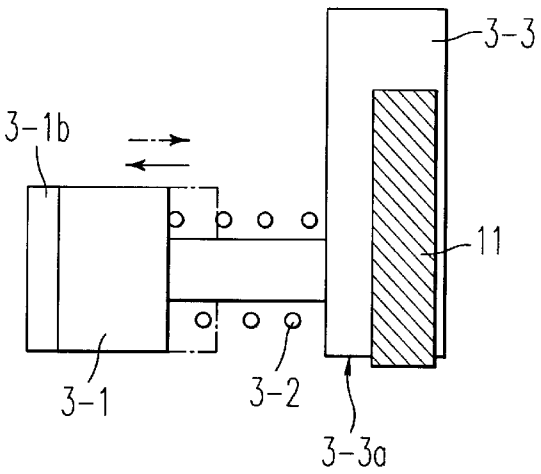
FIG. 7(*a*) is a cross sectional view showing a drive motor for driving the toner supply unit.
Figure 7A:
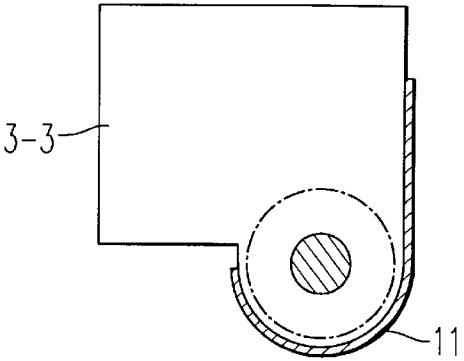

In FIG. 6 and FIGS. 7(*a*) and 7(*b*), the convex curved surface portion 3-3*a* of the drive motor 3-3 is provided with a ribbon-shaped press member, as shown at reference numeral 11.

As describe above, if the press member 11 as press means is attached to the drive motor 3-3, the concave curved portion 4-4 of the receiving bed 4 will ride on the press member 11 when the receiving bed 4 is pushed into the main body 2 as shown in FIG. 4. At this time, the press member 11, fixed to the main body 2 through the drive motor 3-3, depresses the concave curved portion 4-4 of the receiving bed 4. That is, the receiving bed 4 is depressed to the lower sides of the gaps between the engagement portion 4-1 and the guide rail 2-1 and between the engagement portion 4-2 and the guide rail 2-2, so no noise is developed by the receiving bed 4 when the protrusion 1-8 falls in the recess 9. In addition, in the case where an elastic member such as a sponge is used as a press member, an operation of pressing the receiving bed 4 in one direction of the gap can be kept, and furthermore, vibration can also be absorbed, so this case is more effective.

As described above, in the toner supply unit, if vibration is given to the toner housing container 1, the adherence of toner to the interior wall of the toner housing container 1 can be prevented. With this, a quantity of toner remaining in the toner housing container 1 is reduced when discharge of toner is ended. Also, a stable supply quantity of toner is obtainable.

In addition, if a method of giving vibration to the toner housing container 1 is performed as described in the aforementioned embodiment, the whole of the toner housing container 1 is supported by the receiving bed 4 when the protrusion 1-8 falls in the recess 9, so shock sound is low and results in low noise. More specifically, the lower portion of the toner housing container 1 is knocked with two receiving surfaces 4-3 of the receiving bed 4. Toner is present on the lower portion of the toner housing container 1, and each of the contacting portions has a long curved surface in the longitudinal direction of the receiving bed 4. Therefore, wide curved surfaces contact each other, and shock sound is low and results in low noise.

Furthermore, since the recess 9 is formed just under the central axis O of the toner housing container 1, the portion where sound or vibration is developed by the fall of the protrusion 1-8 in the recess 9 is the lower portion of the toner housing container 1 where toner is present by gravitational force, so there is another advantage that the magnitude of sound or vibration can be reduced compared with such structure as to knock a portion where no toner is present.

Since the surface of the protrusion 1-8 is present in a normal direction with respect to the circumferential surface of the toner housing container 1 and contacts the receiving surfaces 4-3 present in a perpendicular direction, the circumferential surface of the toner housing container 1 can be reliably knocked with the receiving bed 4 when the protrusion 1-8 is moved downward.

Moreover, since the toner housing container 1 itself uses flexible material, the circumferential surface of the toner housing container 1 near the protrusion 1-8 bends inwardly of the toner housing container 1 when contacting the receiving surfaces (FIG. 5), or the toner housing container 1 itself is influenced by the receiving surfaces 4-3 and the protrusion 1-8 and warps. Therefore, when the protrusion 1-8 comes to the recess 9 (FIG. 5), the deflection of the circumferential surface of the toner housing container 1 near the protrusion 1-8 returns to the initial state, or the warp of the toner housing container 1 itself returns to the initial state, so the circumferential surface of the toner housing container 1 can be reliably knocked with the receiving bed 4.

Particularly, in order to make use of the deflection or warp of the toner housing container 1, the radial length (height in a normal direction with respect to the circumferential surface) of the protrusion 1-8 is about 5 to 0.5 mm, preferably about 1.5 mm. In this case, the looseness of the engaged portion between the holding portion and the toner housing container 1 or the looseness between the joint 3-1 and the protruding portions 1-1 and 1-2 of the toner housing container 1 is constructed so that it is shorter than the radial length of the protrusion 1-8. The looseness is set to 1 to 0.3 mm, preferably 0.5 mm. If the toner housing container 1 has a diameter of about 40 to 100 mm and uses polyethylene, it will be preferable because an appropriate warp of the toner housing container 1 is obtained.

In this embodiment, the main surface portions on the opposite sides of the rotational direction across the protrusion 1-8 constitute portions to be knocked, and when these portions are positioned downward, these portions where toner is present are knocked and movement of toner is performed.

Now, the mechanism of the discharge of toner from the aforementioned toner housing container 1 will be described with reference to FIG. 33. FIGS. 33(*a*), (*b*), (*c*), and (*d*) show a front view of a toner housing container 150, and FIGS. 33(*a'*), (*b'*), (*c'*), and (*d'*) show an end view of the toner housing container 150. Also, FIGS. 33(*b*), (*c*), and (*d*) show the positions rotated 90° at a time from the position of FIG. 33(*a*). An arrow K represents the rotational direction of the toner housing container 150.

The toner housing container 150 is a cylindrical container housing toner 151. The toner housing container 150 has a small-diameter opening (discharge portion) 152 smaller than the main body at one end thereof, and the interior circumferential surface is formed with a spiral ridge 153. On a portion of the interior surface of the shoulder portion of the end face formed with the opening 151, an inclined surface portion 154 connecting the interior surface of the shoulder portion and the opening 152 together is formed. The inclined surface portion 154 is constituted by a rise-out portion 154*a* for lifting up toner which rises out from the interior surface of the shoulder portion to the edge of the opening 152 and an opening rise-out portion 154*b* for toner discharge which is obliquely formed along the opening 152.

In the position of FIGS. 33(*a*) and (*a'*), toner 151 has been guided to the lower portion of the interior circumferential surface of the toner housing container 150 along the spiral ridge 153. If the toner housing container 150 is rotated 90° from the position of FIG. 33(*a'*) to the position of FIG. 33(*b'*), the boundary portion between the interior circumferential surface of the shoulder portion and the rise-out portion 154*a* will be positioned perpendicularly downward and part of the guided toner 151 will be piled on the rise-out portion 154*a*. Then, while the toner housing container 150 is rotated 90° from the position of FIG. 33(*b'*) to the position of FIG. 33(*c'*) in the direction of arrow K, the rise-out portion 154*a* lifts up the toner 151 to the edge of the opening 152 like a spoon. Furthermore, if the toner housing container 150 is rotated 90° from the position of FIG. 33(*c'*) to the position of FIG. 33(*d'*) in the direction of arrow K, the toner 151 on the rise-out portion 154*a* will be partially transferred to the opening rise-out portion 154*b* and the toner 151 will be discharged from the opening 152 by the inclination of the opening rise-out portion 154*b*.

The toner discharged in this way is supplied to the main body side, and toner consumed by an image forming apparatus is supplemented. This image forming apparatus will hereinafter be described in detail by a second embodiment of the present invention.

(Second Embodiment)

If the toner housing container 150 shown in FIG. 33, for example, is knocked without specifying a portion to be knocked, the following problem will arise. In the figure, if the toner housing container 150 is knocked in the state in which the toner 151 has been piled on the rise-out portion 154*a*, the toner 151 lifted up on the rise-out portion 154*a* will fall in the toner housing container 150 by vibration and there will be the problem that discharge of toner will be disturbed.

A second embodiment of the present invention describes an image forming apparatus and a toner housing container which are capable of causing toner adhering to the interior circumferential surface of the toner housing container to fall and also smoothly performing discharge of toner, without disturbing discharge of toner.

Figure 14:
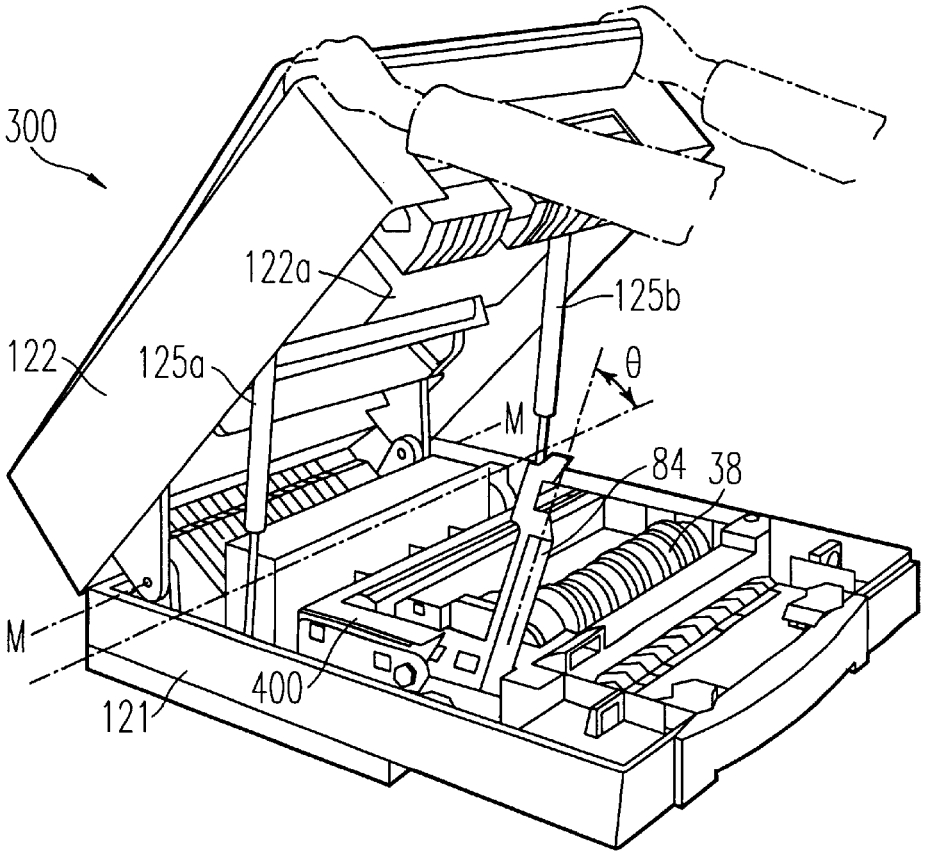
FIG. 14 is a perspective view showing an image forming apparatus according to a second embodiment of the present invention.

FIG. 14 shows an image forming apparatus that is employed in the second embodiment of the present invention. In the figure, reference numerals 121 and 122 denote a main body and a lid, respectively. The main body 121 incorporates a process unit including a toner supply unit, and the lid 122 incorporates an optical scanning unit and an optical exposure system which read out manuscripts. The main body 121 and the lid 122 constitute an image forming apparatus 300.

The process unit constitutes an independent unit, as shown by reference numeral 400 in FIGS. 15, 16, 18, and 19, and it is attached within the frame of the main body 121. In FIG. 14, main-body support members are provided on one end of the main body 121, and lid support members are provided on one end of the lid 122. By a shaft inserted into these support members, the lid 122 is supported so that it can be opened and closed in wide-mouthed form with respect to the main body 121 with axial line M—M as center. Reference numerals 125*a* and 125*b* denote expansion rods, respectively. As shown in FIG. 14, the expansion rods 125*a* and 125*b* are constructed so that the lid 122 can be held in the opened state and also they can be easily contracted by releasing a stopper (not shown) when closing the lid 122.

Figure 15:
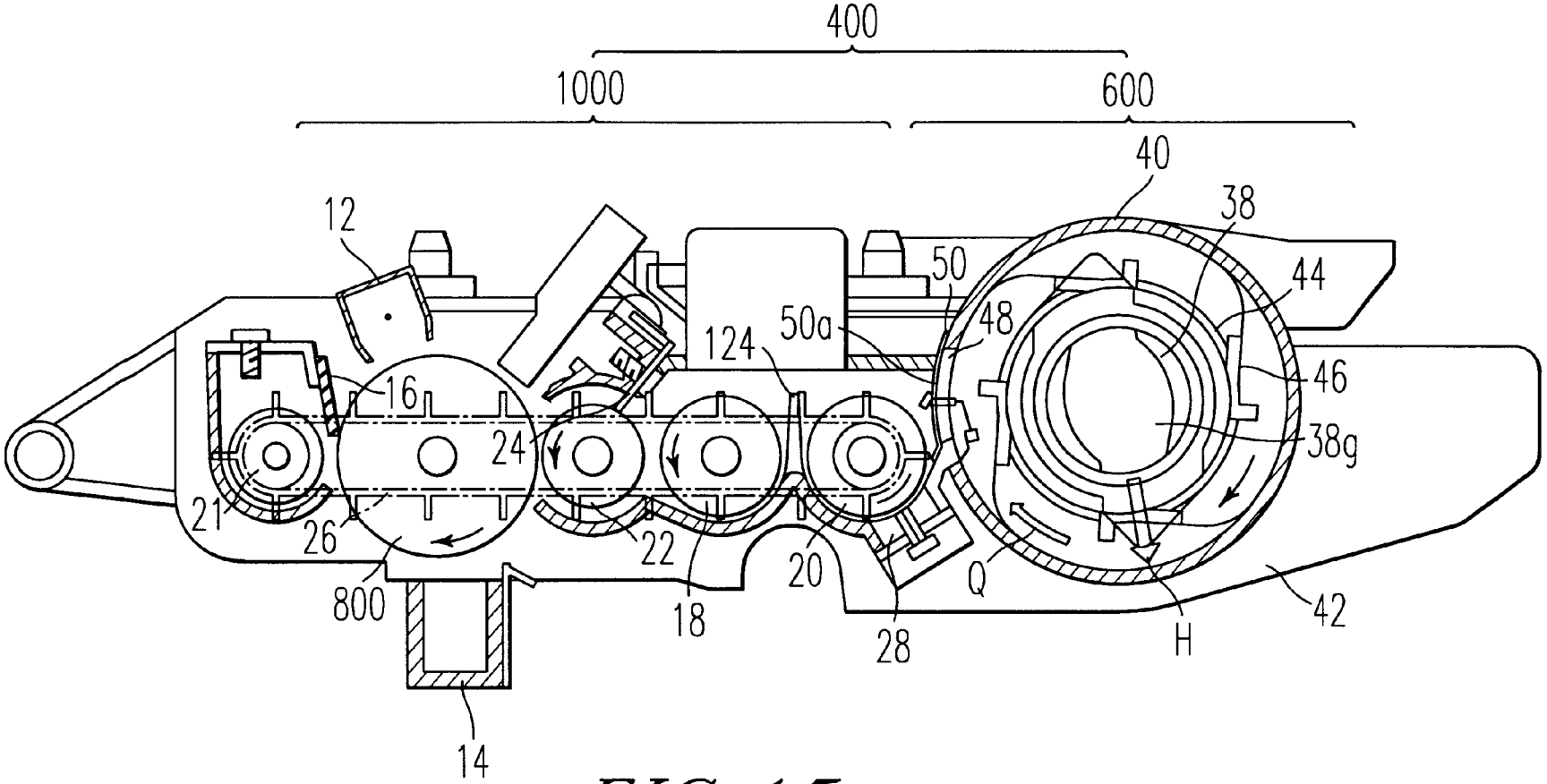
FIG. 15 is a front view showing the process unit of the image forming apparatus of FIG. 14.

Now, a description will be made of the process unit 400 attached within the main body 121. As shown in FIG. 15, the process unit 400 has a toner supply unit 500, a developing unit 1000, a photosensitive body 800, and the peripheral members.

A charger 12, a transfer unit 14, a cleaning blade 16, and a developing sleeve 22 forming part of the developing unit 1000 are provided around the photosensitive body 800. Note that the transfer unit 14 is separated from the process unit 400 and provided on the side of the main body 121.

Figure 16:
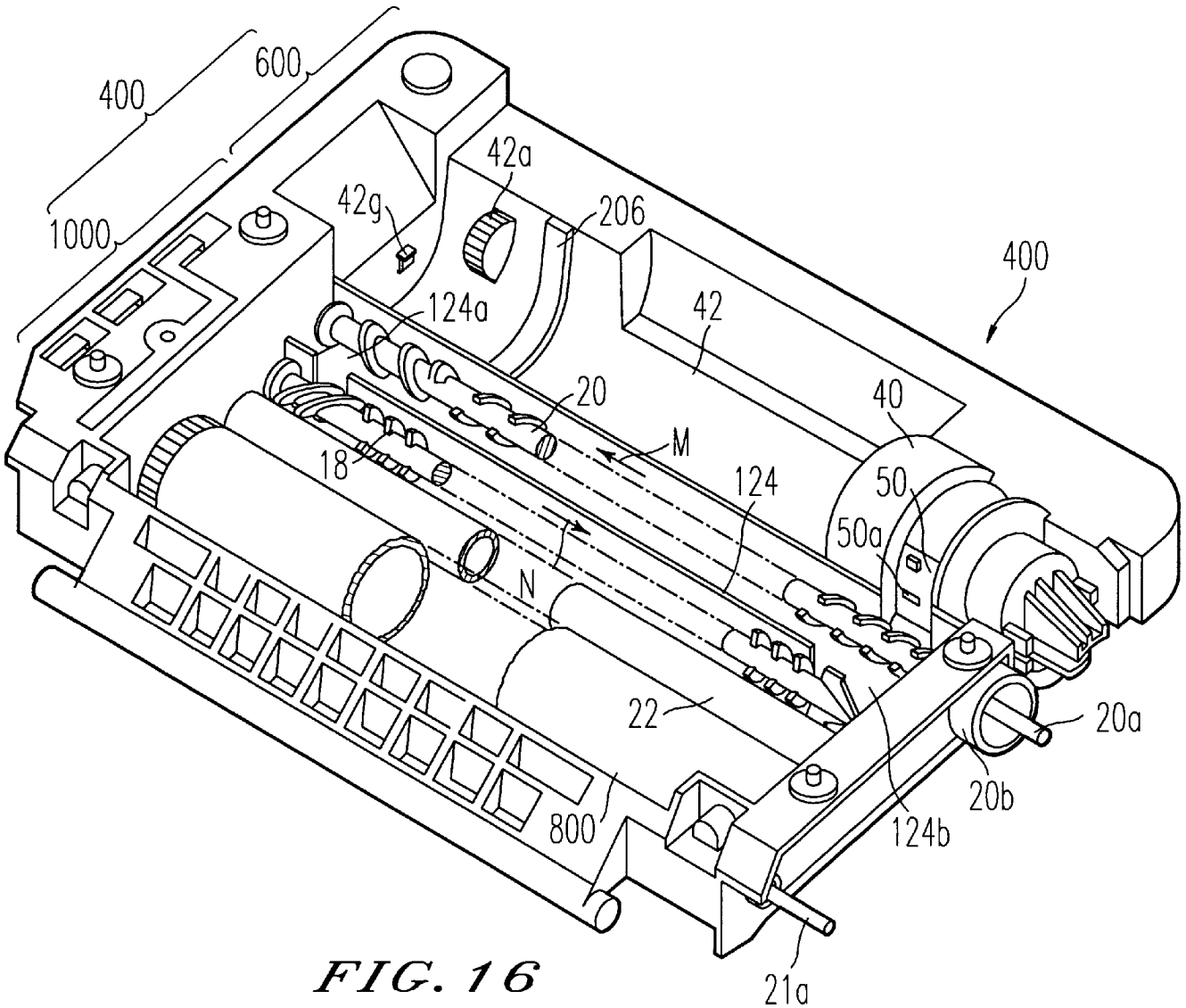
FIG. 16 is a perspective view showing the process unit of the image forming apparatus of FIG. 14, the toner housing container having been removed.

The toner supply unit 600, as shown in FIGS. 15 and 16, is equipped with a toner receiving portion 40 for receiving the toner discharge opening of the toner housing container 38, a toner-housing-container receiving bed 42 integrally constructed with the toner receiving portion 40 for receiving the toner housing container 38, a bolt holding member 44 attached to the toner receiving portion 40 and integrally rotatable with the toner housing container 38, opening and closing means for switching a cap 68 (FIG. 18) of the toner housing container 30 to the opened state or the closed state, and a lever 84 for acting on this opening and closing means to hold the cap 68 in the opened state or the closed state. The opening and closing means is mainly constituted by a collet chuck 70, a cylindrical casing 72, a shaft member 76, a spring 82, and a slide shaft 86, as shown in FIG. 20 to be described later.

Figure 20:
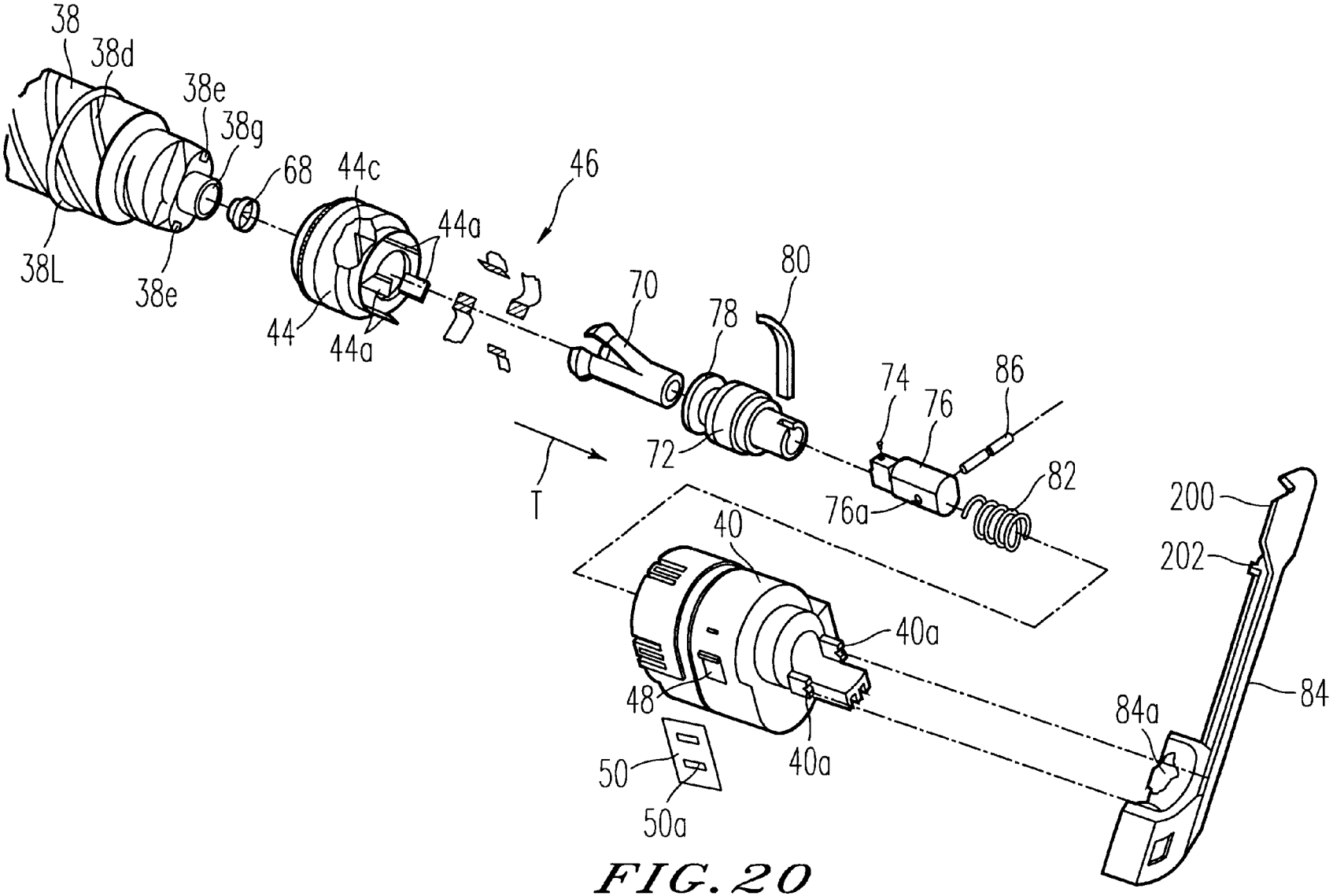
FIG. 20 is an exploded view showing how the toner housing container is loaded into the toner supply unit of FIG. 14.

The toner receiving portion 40 is formed with an opening 48 as shown in FIG. 20, and on the exterior surface of the opening 48 an elastic supply quantity regulating member 50 for discharging an appropriate toner supply quantity is arranged. Toner is discharged from a slit 50*a* provided in the supply quantity regulating member 50.

Figure 8:
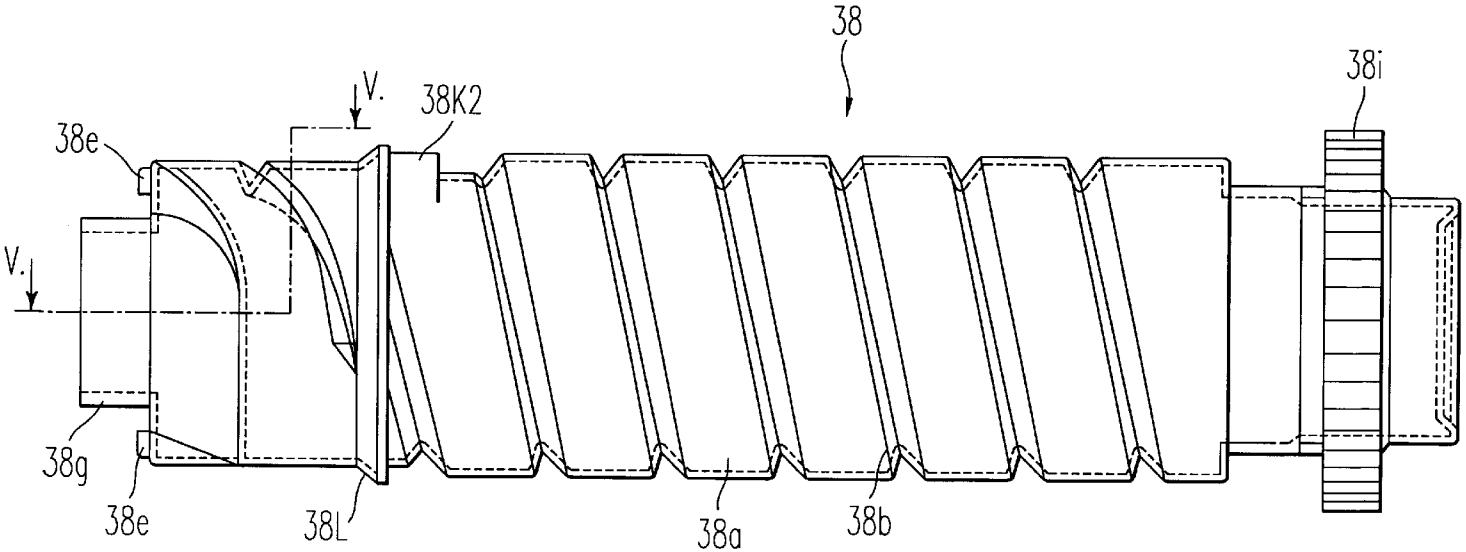
FIG. 8 is a plan view of a toner housing container according to a second embodiment of the present invention.
Figure 9:
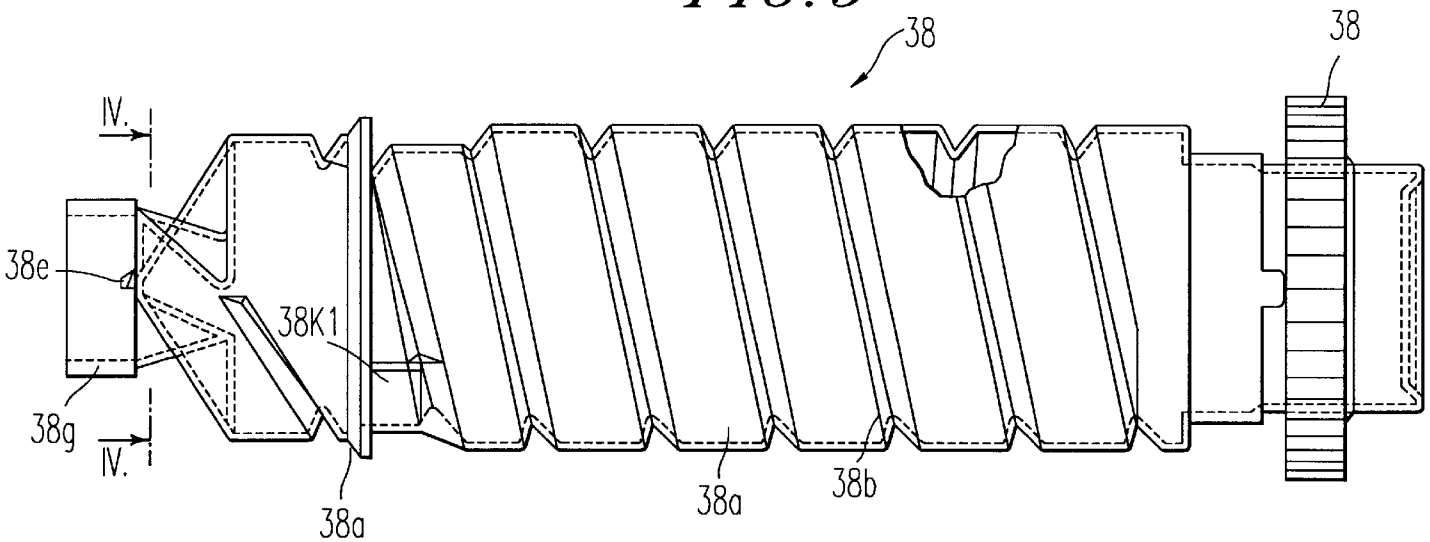
FIG. 9 is a part-sectional plan of the toner housing container with a discharge portion shown along line V—V of FIG. 8.
Figure 10:
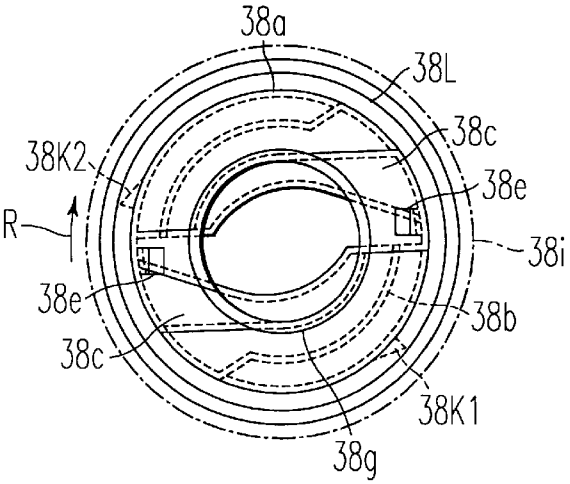
FIG. 10 is a front view of the toner housing container shown in FIG. 8.

The rear portion of the receiving bed 42 is provided with a driving gear 42*a* and a spring 42*g*, as shown in FIG. 16. The driving gear 42*a* is rotated by drive means (not shown). When the toner housing container 38 (FIG. 8) is placed on the receiving bed 42, the driving gear 42*a* meshes with a driven gear 38*a* provided on the toner housing container 38 and rotates the toner housing container 38. The spring 42*g* urges the toner housing container 38 upward so that the meshing of the driving gear 42*a* with the driven gear 38*a* can be performed with reliability.

Figure 21:
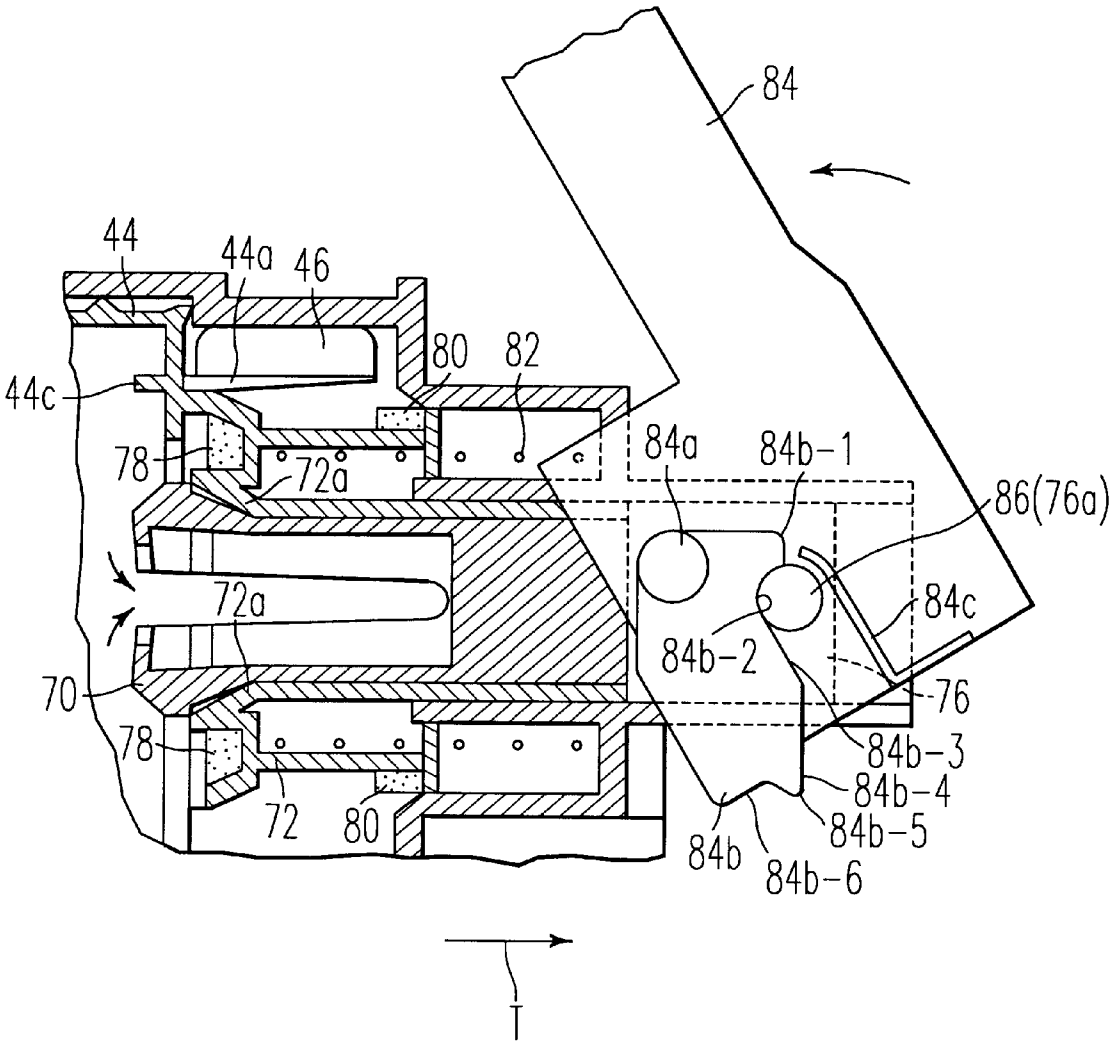
FIG. 21 is a part-sectional view showing the opening and closing means of the toner housing container in the toner supply unit of FIG. 19.

As shown in FIGS. 20 and 21, the front end of the toner-housing-container holding member 44 is formed integrally with a plurality of outer ribs 44*a*. To each outer rib 44*a* an extrusion member 46 consisting of Mylar or an elastic body, such as rubber, is attached with double-faced tape. The interior wall surface of the toner-housing-container holding member 44 is provided with an inner rib 44*c*. This inner rib 44*c* is constructed so that it engages a protruding piece portion 38*e* provided on the discharge opening side of the toner housing container 38, and also the toner-housing-container holding member 44 and the toner housing container 38 are integrally rotated with each other.

The collet chuck 70 is a member for gripping the cap 68, and as shown in FIGS. 18 and 20 through 23, it is incorporated into the cylindrical casing 72 having a protruding portion 72*a*. The collet chuck 70 and the shaft member 74 are connected together by means of a screw 74. Reference numerals 78 and 80 denote seal members and reference numeral 82 denotes an extensible spring. The spring 82 pressurizes the cylindrical casing 72 toward the toner-housing-container holding member 44.

Figure 17:
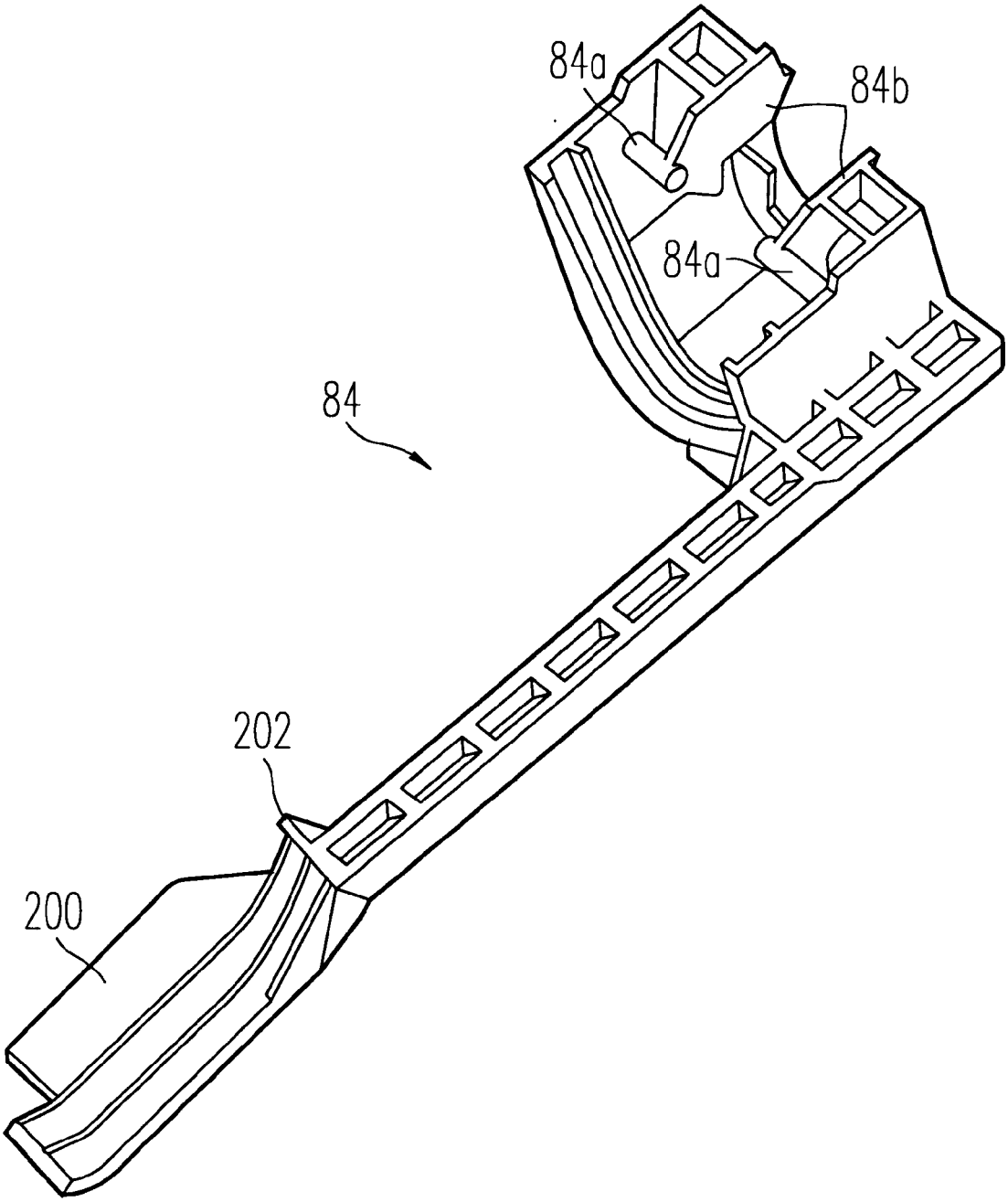
FIG. 17 is a perspective view of the lever shown in FIG. 14.

The lever 84 consists of an elastic body such as synthetic resin. This lever 84, as shown in FIG. 17, has two shaft portions 84a at the proximal portion thereof and also has a grip 200 at the free end portion thereof. The shaft portions 84*a* are formed integrally with cam members 84*b*, respectively. The grip 200 is provided with a knocking portion 202 at the proximal portion thereof. This knocking portion 202 is a plate-shaped knocking member provided parallel to a surface perpendicular to the rotational axis direction of the toner housing container 38 to be described later.

The cam member 84*b*, as shown in FIG. 21, has a stopper portion 84*b*-1, a first click portion 84*b*-2, inclined surface portions 84*b*-3 and 84*b*-4, a protrusion 84*b*-5, and a second click portion 84*b*-6. The shaft portions 84*a* of the lever 84, as shown in FIGS. 20 and 21, are fitted into the recesses of shaft support portions 40*a* formed on the side wall portion of the toner receiving portion 40, whereby the lever 84 is supported so that it is rotatable on the shaft portions 84*a*.

Now, a description will be made of the constitution of the opening and closing means.

As shown in FIG. 20, the collet chuck 70 is pushed by the hand in a direction of arrow T against the elasticity of the spring 82 in the state in which the lever 84 has been attached to the toner receiving portion 40. As shown in FIG. 21, in the state in which the hole 76*a* of the shaft member 76 is let out on the side of the arrow T beyond the cam portion 84*b*, if the slide shaft 86 is inserted into the hole 76*a* and releases the pushed state of the collet chuck 70, movement of the cylindrical casing 72 by the elastic force of the spring 82 will be hindered by abutting the toner-housing-container holding member 44, and only movement by dead weight will act on the lever 84. At this time, in the state in which the slide shaft 86 engages the concave first click portion 84*b*-2 formed in the cam member 84*b*, the lever 84 is held.

Figure 18:
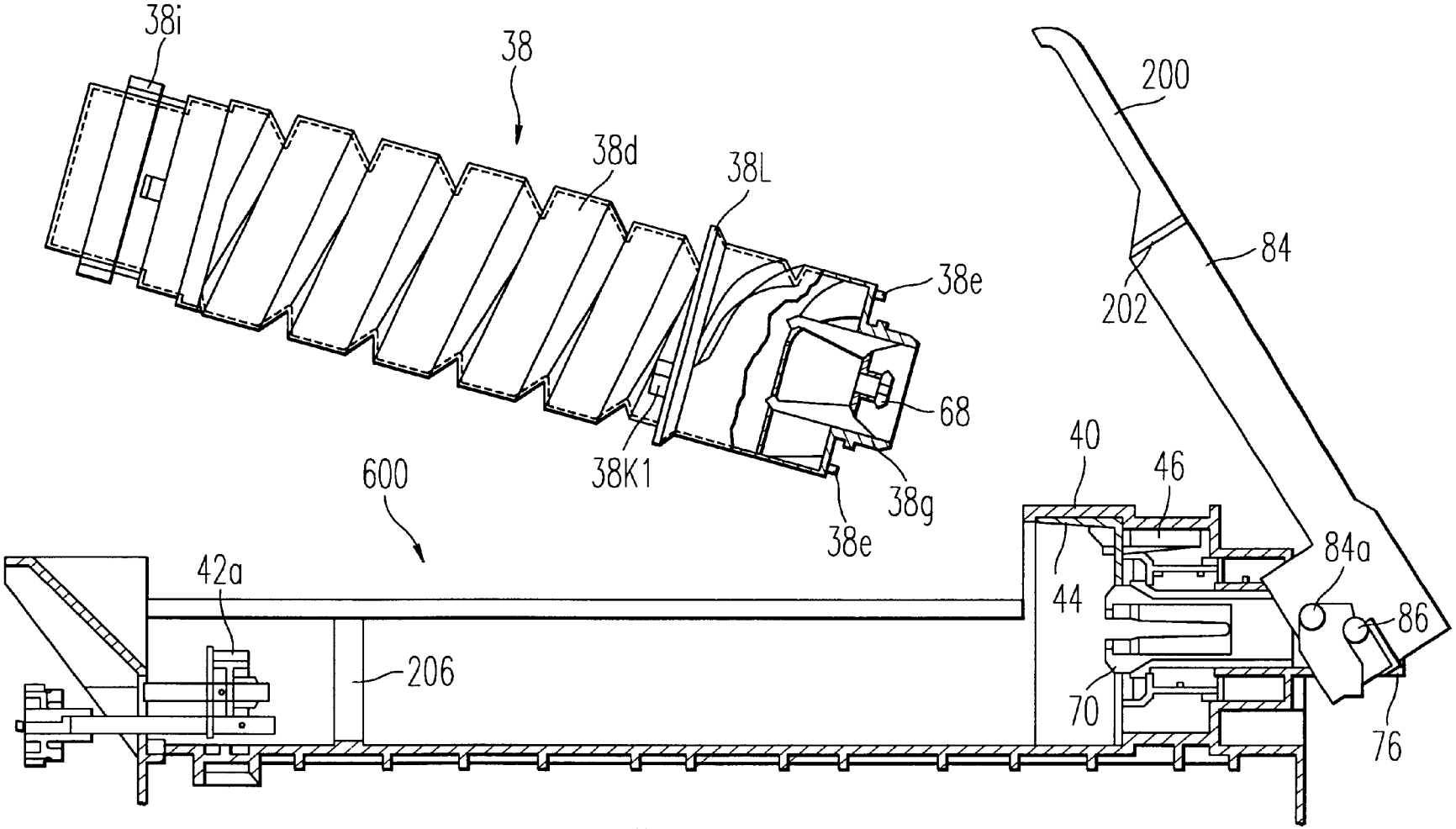
FIG. 18 is a sectional view showing the toner supply unit of FIG. 14 along with the toner housing container.

The toner housing container 38, as shown in FIGS. 8 through 13, has a container main body 38*a*, a toner discharge portion 38*g* formed on one end of the container main body 38*a* so as to be smaller in diameter than the container main body 38*a*, and a gear 38*a* integrally formed with the container main body 38*a* near the other end of the container main body 38*a*. On the interior circumferential surface of the container main body 38*a* a spiral ridge 38*b* is formed, and on the exterior circumferential surface of the container main body 38*a* an alligator-shaped member 38L is formed. As shown in FIG. 18, the cap 68 is fitted into the toner discharge portion 38*g*. The spiral ridge 38*b* is formed in a direction in which toner housed within the container main body 38*a* is conveyed from the bottom portion (the other end) toward the toner discharge portion 38*g*, when the toner housing container 38 is rotated in a direction of arrow R shown in FIG. 10.

Furthermore, the shoulder portion exterior circumferential surface of the end face on the side of the toner discharge portion 38*g* of the container main body 38*a* is provided with protruding piece portions 38*e* engageable with the inner rib 44*c*. The interior circumferential surface near the aforementioned shoulder portion is provided with inclined surface portions 38*c* linking the spiral ridge 38*b* and the toner discharge portion 38*g* together. The exterior circumferential surface of the container main body 38*a* near the alligator-shaped member 38L is provided with protrusions 38K1 and 38K2 engageable with the knocking portion 202.

Figure 11C:
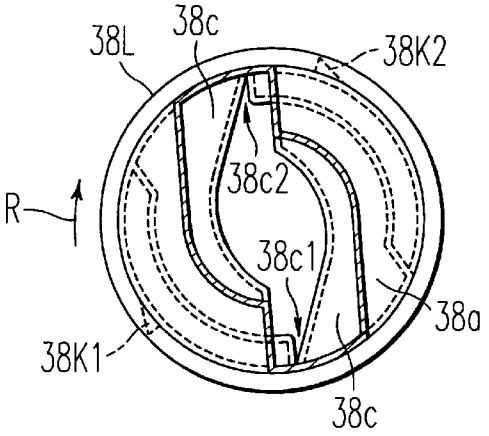
FIG. 11(*a*) is a cross sectional view showing the toner housing container taken substantially along line IV—IV of FIG. 9.
Figure 11B:
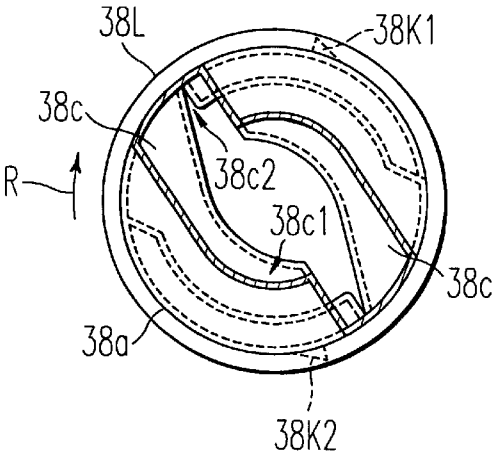
Figure 11A:
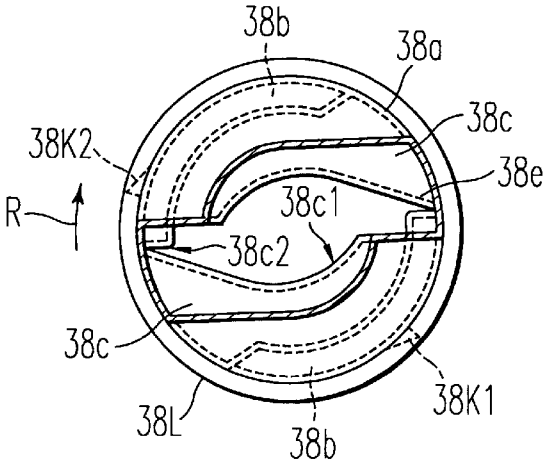
Figure 12:
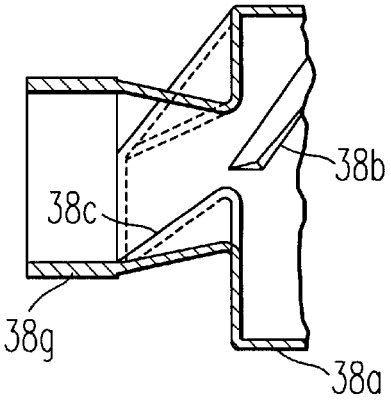
FIG. 12 is a cross sectional view showing the toner housing container taken substantially along line V—V of FIG. 8.
Figure 13:
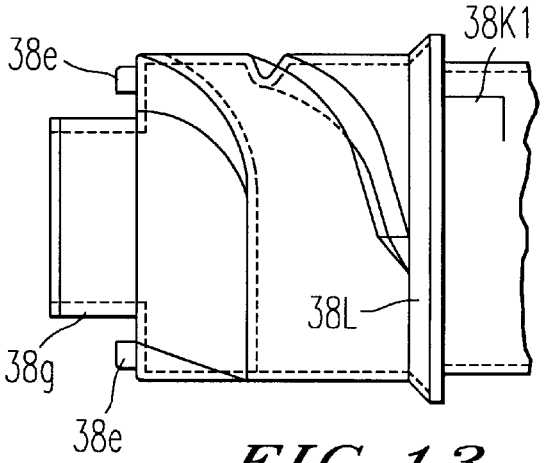
FIG. 13 is a part-side view of the toner housing container of FIG. 8.
Figure 26:
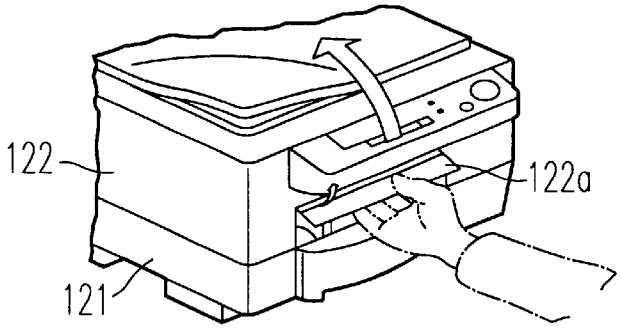

The inclined surface portion 38*c*, as shown in FIG. 11(*a*), has a toner fall position 38*c*1 which is a portion connected to the toner discharge portion 38*g* and a toner rise preparation position 38*c*2 which is a portion connected to the spiral ridge 38*b*. The portion from the toner rise preparation position 38*c*2 to the intermediate portion of the inclined surface portion 38*c* corresponds to the rise-out portion 154*a* (FIG. 33), and the portion from the intermediate portion to the toner fall position 38*c*1 corresponds to the opening rise-out portion 154*b* (FIG. 26). If the toner housing container 38 rotates in a direction of arrow R, toner housed within the container main body 38*a* will be exhausted from the toner discharge portion 38*g* through the same process as the process described in FIG. 33.

The protrusion 38K1 provided integrally on the container main body body 38*a* is formed so as to be lower in height than the alligator-shaped member 38L. The formation position, as shown in FIG. 11(*b*), is provided so that when the toner housing container 38 rotates in the direction of arrow R and the toner fall position 38*c*1 is positioned perpendicularly downward, the protrusion 38K1 is positioned slightly on the downstream side of the rotational direction from perpendicularly upward. Likewise, the protrusion 38K2 is provided integrally with the container main body 38*a*, and the height is higher than the protrusion 38K1 and slightly lower than the alligator-shaped member 38L. The protrusion 38K2, as shown in FIG. 11(*c*), is provided so that when the toner rise preparation position 38*c*2 is positioned perpendicularly downward, the protrusion 38K2 is positioned slightly on the downstream side of the rotational direction from perpendicularly upward.

In FIGS. 15 and 16 the developing unit 1000 has agitation screws 18 and 20, a conveyor screw 21, and a developing sleeve 22. The agitation screws 18 and 20 are obliquely provided with a plurality of ½ elliptic plates, and have a function of conveying a developing agent in the axial direction by the rotation. This developing agent contains toner and the details will be described later. The conveyor screw 21 is a screw conveyor, and although not shown in FIG. 16, it is arranged on the extension of a shaft 21*a* and along the side portion of the photosensitive body 800. The conveyor screw 21 feeds toner scraped off by the cleaning blade 16 in the direction of the shaft 21*a*.

The shaft 21*a* shown in FIG. 16 and the shaft portion 20*a* of the agitation screw 20 are provided with pulleys, respectively. Between these pulleys, a toner recycle belt represented by reference numeral 26 extends, and the periphery of this toner recycle belt 26 is covered with a cover shown by reference numeral 25 in FIG. 19. Therefore, within the space covered with this cover 25, toner fed in the shaft direction by the conveyor screw 21 is fed to the side of the agitation screw 20 through the cylindrical portion 20*b* by the toner recycle belt 26.

On the other hand, in FIG. 15, new toner from the toner housing container 38 is supplied to the right oblique upper portion of the agitation screw 20 through the toner receiving portion 40. The toner (arrow H) that flowed from the toner discharge portion 38*g* of the toner housing container 38 to the toner receiving portion 40 is pushed up (arrow Q) by the rise-out member 46 of the toner-housing-container holding member 44 and is supplied through the slit 50*a* of the toner quantity regulating member 50 (arrow P) to the oblique upper portion of the agitation screw 20.

Describing about the flow of new toner supplied to the agitation screw 20, in FIG. 16, the toner that flowed out from the slit 50*a* is fed in a direction of arrow M along with toner from the toner recycle belt 26 by rotation of the agitation screw 20 and is transferred from the end opening 124*a* of a partition wall 124 to the side of the agitation screw 18. Then, the toner is supplied to the developing sleeve 22, while it is being fed in a direction arrow N by rotation of the agitation screw 18. The remaining toner is fed further in the direction of arrow N and returned from the end opening 124*b* of the partition wall 124 to the side of the agitation screw 20. Then, the returned toner joins new toner, or toner supplied form the toner recycle belt 26. While the aforementioned circulation is being repeated, image development is performed.

The developing sleeve 22 has an inner fixed shaft on which five pole magnets are arranged, and this exterior circumferential surface is covered with non-magnetic pipe material. If this pipe material is rotated, a developing agent will be moved on and along the developing sleeve 22. The developing agent employed here is a two-component developing agent consisting of carriers and toner. The developing agent is circulated while being agitated with the agitation screws 18 and 20. With this, the toner has electric charges and adheres to carriers. The toner adhering to the carriers is conveyed onto the surface of the photosensitive body 800, and adheres to the photosensitive body 800 by electrostatic force action. In this developing agent, carriers are circulated but toner adheres to the image portion on the photosensitive body 800 and is consumed. For this reason, toner is supplied from the toner housing container 38 in accordance with the output of a toner density sensor 28. Also, if the supply quantity of a developing agent to the photosensitive body 800 is not constant, problems, such as an image density defect and density fluctuation, will arise. For this reason, a doctor blade 24 is arranged in order to regulate the inflow quantity of the developing agent.

The imaging operation will be performed as follows:

In FIG. 15 the photosensitive body 800 is discharged by a discharger and the surface potential is averaged to a reference potential of 0 to−150 V. Then, the photosensitive body 800 is charged by the charger 12 and the surface potential becomes about −900 V. Next, it is exposed by the optical exposure system provided in the lid 122 and an electrostatic latent image is formed. This electrostatic latent image is formed into a visible image by toner supplied from the developing sleeve 22. Thereafter, the photosensitive body 800 with an toner image formed thereon is rotated, and this toner image is transferred to a transfer paper fed from a paper feed portion (not shown) at the transfer unit 14. After image transfer, the transfer paper is fixed by a fixing portion and is discharged out of the apparatus.

On the other hand, the photosensitive body 800 is further rotated after image transfer, and the remaining toner is removed by the cleaning blade 16 for forming the next image. The toner removed by the cleaning blade 16 is returned to the agitation screw 20 by the toner recycle belt 26, as described above. The returned toner is again employed for image development.

Figure 19:
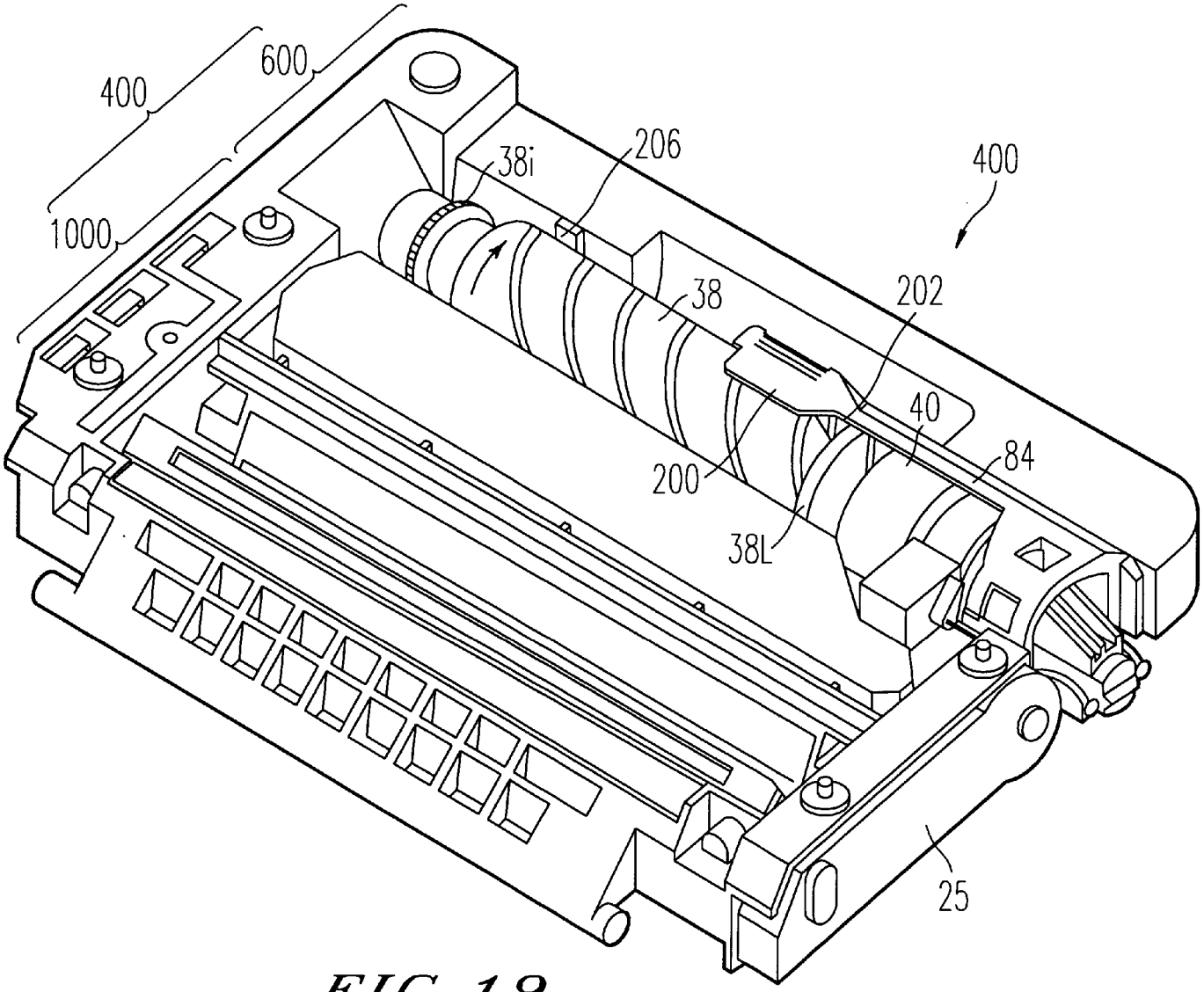
FIG. 19 is a perspective view showing the process unit of the image forming apparatus of FIG. 14, the toner housing container having been loaded into the toner supply unit.

FIG. 19 shows the process unit 400 in which the toner housing container 38 has been loaded into the toner supply unit 600. In the position shown in FIG. 19, the discharge portion 38*g* of the toner housing container 38 is inserted into the toner receiving portion 40, and the shoulder portion is pushed against the inner rib 44*c*. The bottom portion of the toner housing container 38 is pressed by the spring 42*g* (FIG. 16) and is placed on the receiving bed 42 in a correct state in which the driven gear 38*i* and the driving gear 42*a* mesh with each other. In the cap-closed state of the toner housing container 38 (state of FIG. 21), if the lever 84 is rotated in a counterclockwise direction, the slide shaft 86 will be moved along the inclined surface portions 84*b*-3 and 84*b*-4 in the direction of arrow T (FIG. 22), and the collet chuck 70 will abut the protrusion 72*a* and will be closed. In this process the collet chuck 70 grips and pulls out the cap 68.

Figure 23:
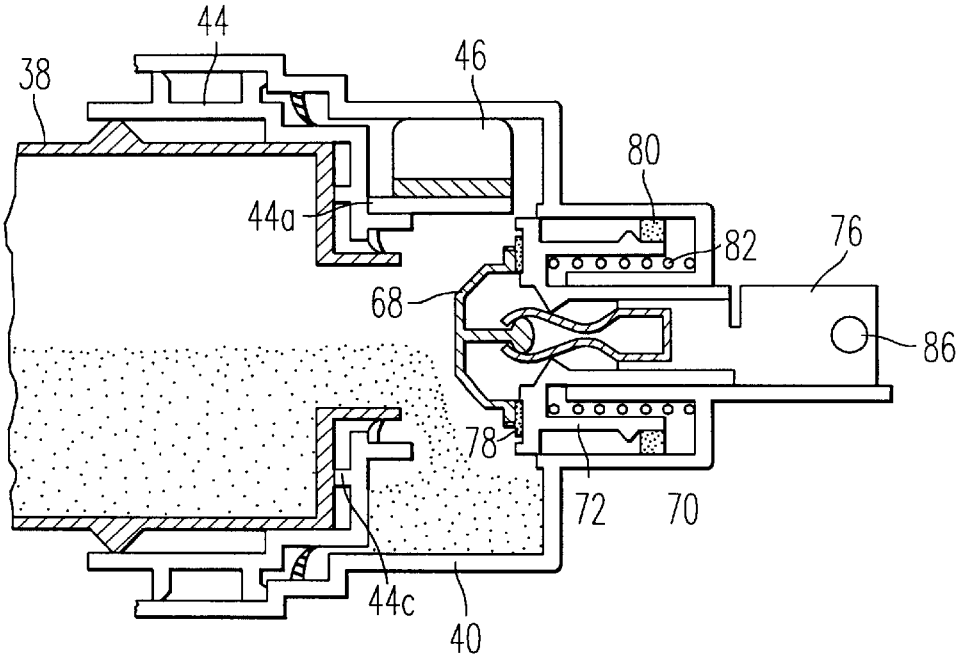
FIG. 23 is a view similar to FIG. 22, the cap of the toner housing container having been opened by the opening and closing means of FIG. 21.

Furthermore, when the slide shaft 86 rides across the protrusion 84*b*-5 and is positioned at the second click portion 84*b*-6, the cap 68 is caused to be in the opened state as shown in FIG. 23, and the position of the slide shaft 86 would be held at the second click portion 84*b*-6 by the elasticity of the spring 82 even if rotation of the lever 84 were stopped. This position corresponds to a cap opening position at which the lever 84 is pulled down as shown in FIG. 19. At this cap opening position, the grip 200 is positioned near the circumferential surface of the toner housing container 38, and the rotational locus of each of the protrusions 38K1 and 38K2 which rotate together with the toner housing container 38 is coincident with the position of the knocking portion 202.

Figure 24:
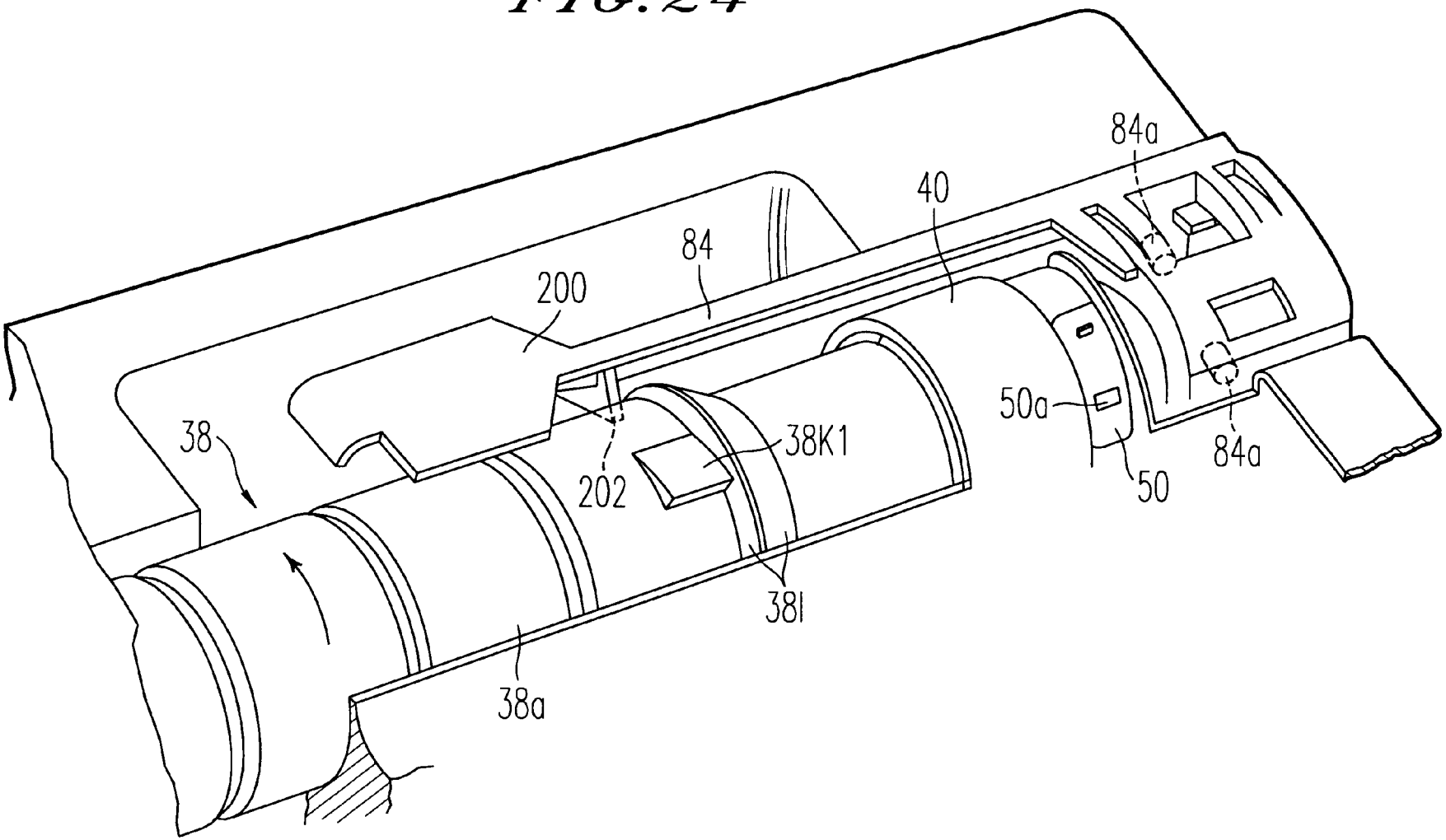
FIG. 24 is a perspective view showing the toner housing container loaded into the toner supply unit.
Figure 31:
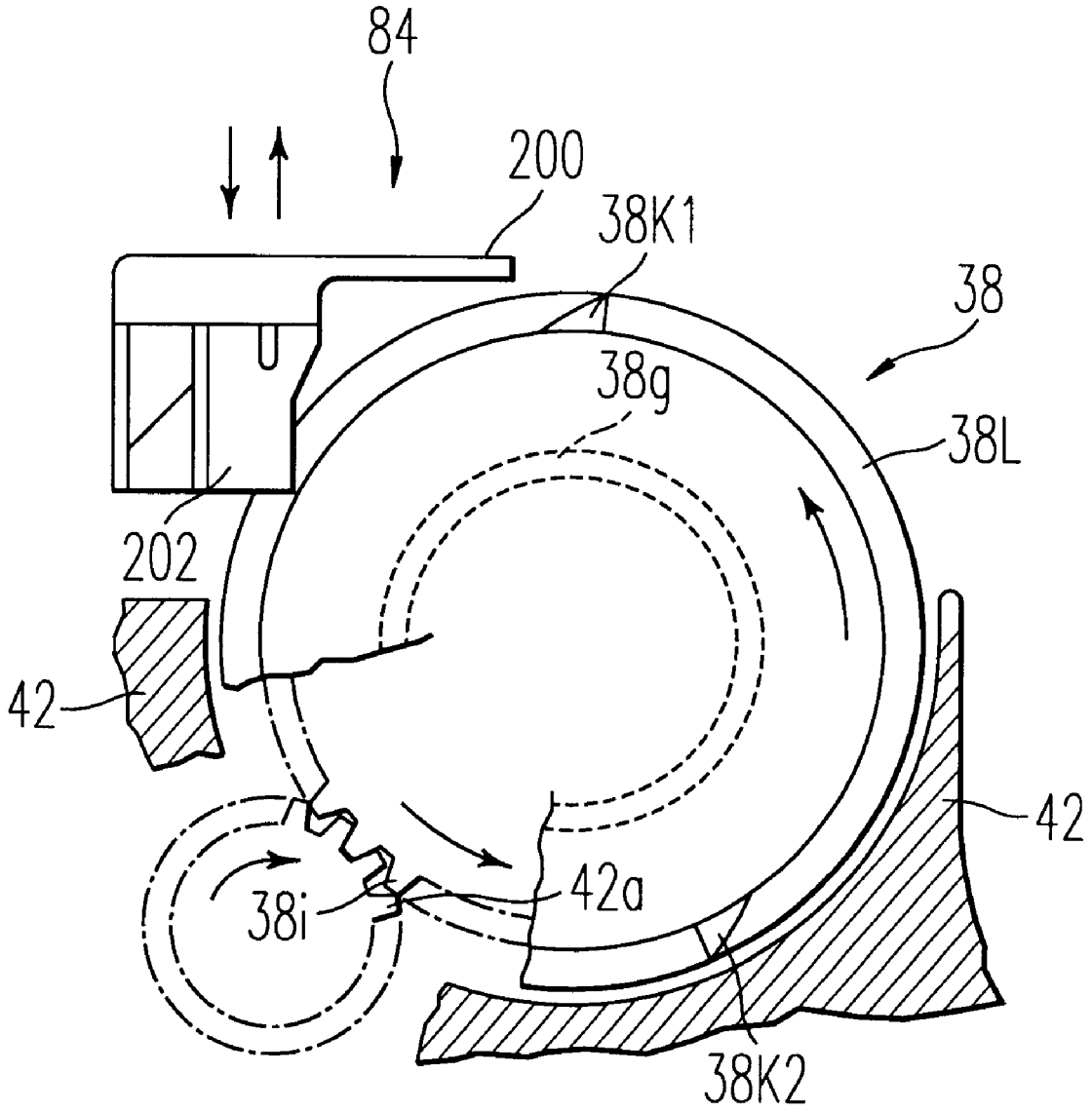
FIG. 31 is a part-sectional view showing the positional relationship between the toner housing container and the lever.

In FIGS. 24 and 31 the position of the knocking portion 202 of this lever 84 is at a position offset on the downstream side (or upstream side) of the rotational direction of the toner housing container 38 from the top of the toner housing container. In other words, in the example of FIG. 24 the knocking portion 202 is at the position of 11 o'clock when the toner housing container 38 is seen from the bottom side.

The present invention is not limited to the aforementioned example. The point here is that the toner housing container 38 is knocked not at the horizontal and vertical circumferential surfaces but at the oblique circumferential surface by the lever 84. As shown in FIG. 31, if the position of the lever 84 is offset in an oblique direction, the lever 84 can be thickened to increase strength. With this, an additional space which is caused by the thickness of the lever is not required in the height direction and the lateral direction, and consequently, space can be saved.

When the lever 84 is at the cap opening position, the knocking portion 202 of the lever 84 periodically engages the protrusions 38K1 and 38K2 of the toner housing container 38 being rotated. As previously described, since the lever 84 is constituted by an elastic body, the free end thereof can be lifted up by reflection with the proximal portion as a fulcrum. Therefore, the knocking portion 202 rides on the protrusions 38K1 and 38K2, as the toner housing container 38 is rotated, and when the knocking portion 202 passes the protrusions 38K1 and 38K2, it falls on the container main body 38*a* and knocks the exterior circumferential surface of the container main body 38*a*. Thus, the lever 84 also serves as a member for knocking the toner housing container 38.

When the toner housing container 38 is knocked, toner staying on the interior circumferential surface of the container main body 38*a* is separated by vibration or shock and flows along the spiral ridge 38*b*, whereby toner supply is smoothly performed. In this embodiment, as shown in FIGS. 11(*b*) and 11(*c*), the knocking portion 202 knocks the container main body 38*a* when the toner fall position 38*c*1 and the toner rise preparation position 38*c*2 are positioned perpendicularly downward, so the discharge of toner from the toner discharge portion 38*g* can be assisted and also toner can be favorably lifted up to the toner discharge portion 38*g*. In addition, the protrusions 38K1 and 38K2 are different in length in the normal direction (height) from each other. For example, since the protrusion 38K1 is lower in height than the protrusion 38K2, the initial discharge quantity of toner can be reduced and the occurrence of an image defect due to an excess of toner supply can be prevented. Note that the heights of the protrusions 38K1 and 38K2 are set to predetermined values so that the knocking portion 202 can sufficiently exhibit its knocking function.

By rotation of the toner housing container 38, toner within the container main body 38*a* moves along the spiral ridge 38*b* and is discharged from the toner discharge portion 38*g*. Toner discharged into the toner receiving portion 40 is dipped up by the rise-out member 46 and is supplied to the developing unit 1000 via the slit 50*a*.

This developing unit 1000 is equipped with a toner density sensor 28 for detecting toner density. The aforementioned toner supply is performed based on the toner density in the developing unit 1000 detected by the toner density sensor 28. In the case where the detection result of the toner density sensor 28 is less than a reference value, the toner housing container 38 is rotated by the driving gear 42*a* actuated by drive means (not shown), thereby resupplying toner.

If the lever 84 is returned to the contrary of the aforementioned operation, the slide shaft 86 will move in a direction opposite the direction of arrow T, and according to this movement, the lever 84 will return to the position shown in FIG. 21 where the cam portion 84*b* of the lever 84 positions the slide shaft 86 at the first click portion 84*b*-2. With this, the lever 84 is held at a position at which the cap 68 is returned to the closed state. This position corresponds to a cap closing position at which the lever 84 is raised up as shown in FIG. 18.

Thus, the lever 84 serves as opening and closing means which rotates between the cap opening position and the cap closing position. In the cap opening position the cap 68 of the toner housing container 38 is held in the opened state as shown in FIG. 23, and in the cap closing position the cap 68 is held in the closed state.

Now, a procedure of exchanging the toner housing container 38 will be described.

Figure 25:
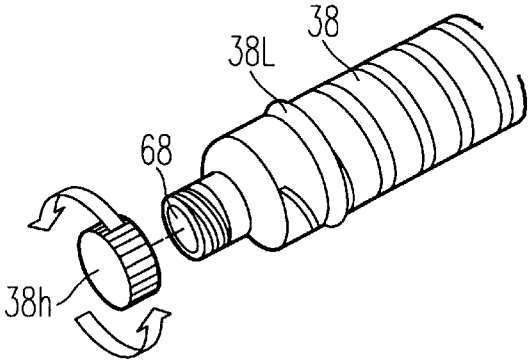
FIGS. 25 through 30 are perspective views showing how the toner housing container is exchanged.

1. As shown in FIG. 25, an outer cap 38*h* of a new toner housing container 38 filled with toner is removed to make preparations for loading. In this stage the cap 68 has still been fitted into the toner housing container 38.

2. As shown in FIG. 26, the lid 122 is opened by releasing a stopper lever 122*a* which has been locked in the closed state of the lid 122. The lid 122 is held in the opened state by the support rods 125*a* and 125*b*. At this time, the lever 84 is in the cap opening position at which it is pulled down, as shown in FIG. 19, and the slide shaft 86 has engages the second click portion 84*b*-6 of the lever 84.

Figure 27:
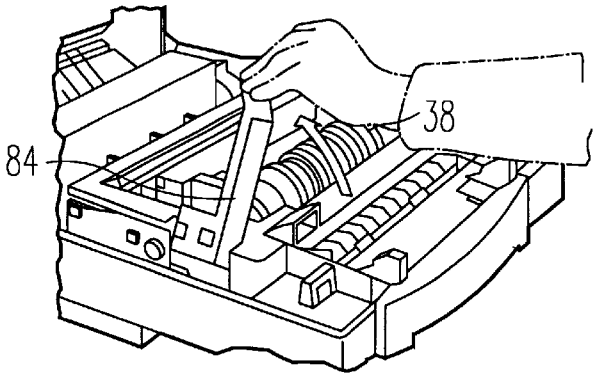

3. As shown in FIG. 27, the lever 84 is pulled up and rotated to the cap closing position. With the process of this pull-up operation, the opening and closing means is switched to the closed state, and the slide shaft 86 engages the first click portion 84*b*-2 and the lever 84 is held.

Figure 28:
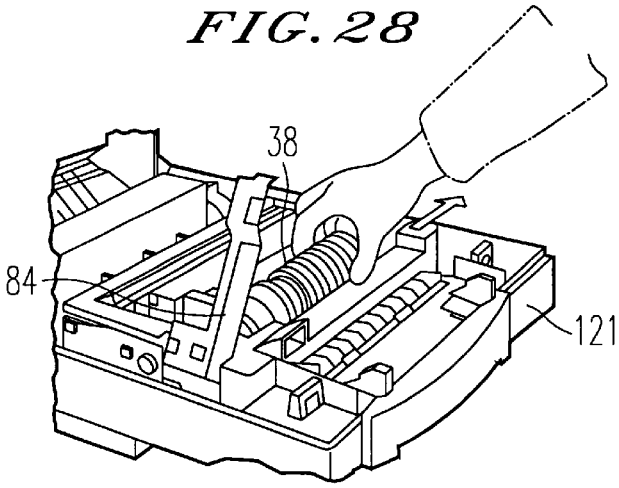

4. As shown in FIG. 28, the toner housing container 38 to be exchanged, such as an empty toner housing container, is taken out of the toner supply unit 600.

Figure 22:
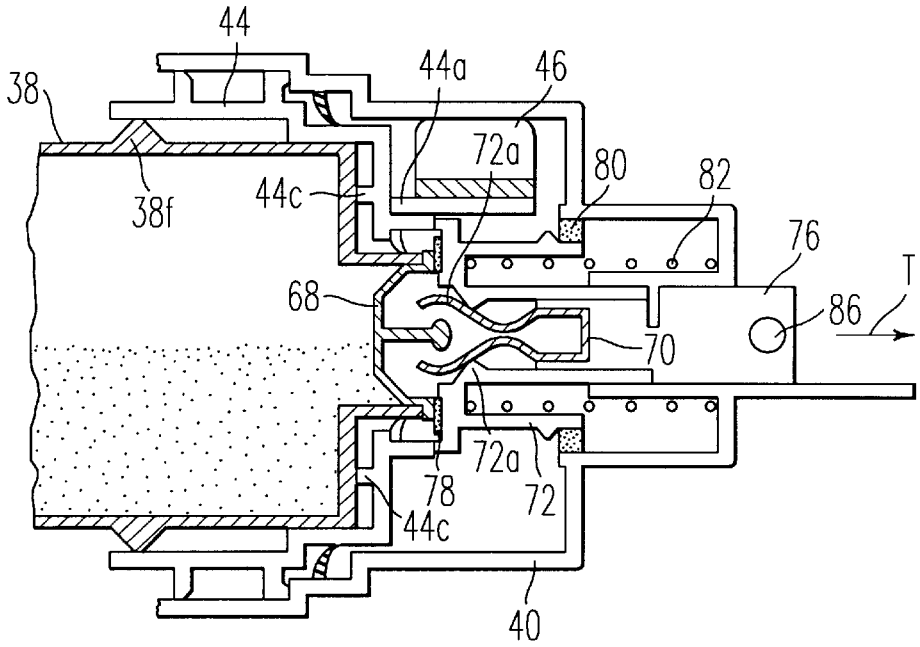
FIG. 22 is a part-sectional view showing how the cap of the toner housing container is opened by the opening and closing means of FIG. 21.
Figure 29:
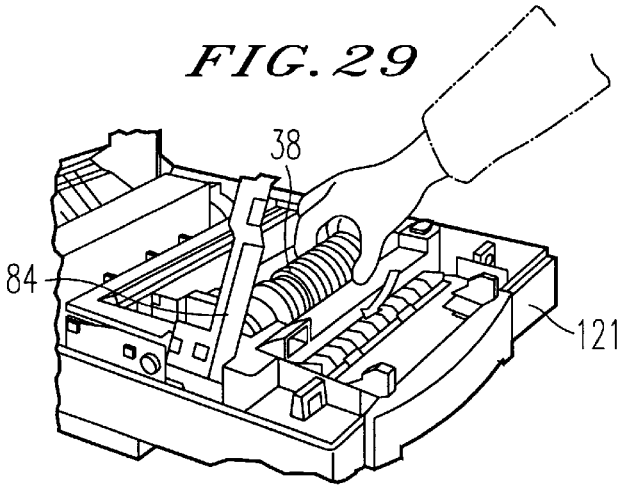
Figure 30:
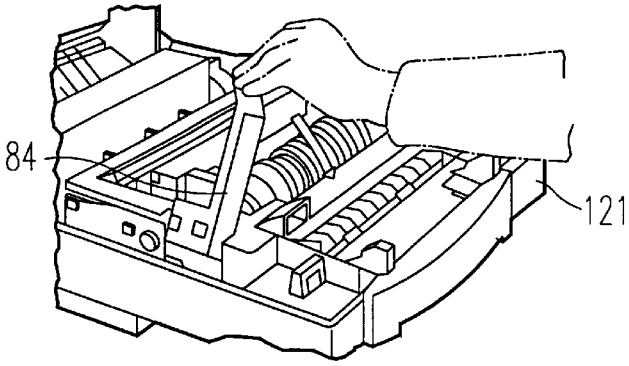

5. As shown in FIGS. 18 and 29, the new toner housing container 38 prepared in the procedure 1 is loaded into the toner supply unit 600. In the loaded state, the toner housing container 38 is housed within the receiving bed 42. Also, the shoulder portion of the discharge portion 38*g* abuts the inner rib 44*c* of the toner receiving portion 44, as shown in FIG. 22. The bottom portion of the toner housing container 38 is pressed by the spring 42*g* shown in FIG. 16.

6. As shown in FIG. 23, the lever 84 is pulled down so that it is held again at the cap opening position. Thereafter, the stopper of the support rods 125*a* and 125*b* is released and the lid 122 is closed. With this, toner supply from the new toner housing container 38 becomes possible.

Note that the knocking portion 202 of the lever 84 is held near the exterior circumferential surface of the toner housing container 38, because if it is held in contact with the exterior circumferential surface, it will produce resistance when the toner housing container 38 is rotated and also if it is too far away, the knocking operation will be insufficient.

Hence, the lever 84 is formed from an elastic or flexible member. If the knocking portion 202 of the lever 84 rides on the protrusions 38K1 and 38K2 of the toner housing container 38, the lever 84 will be bent. When the knocking portion 202 is disengaged from the protrusions 38K1 and 38K2 by the rotation of the toner housing container 38 thereafter, the lever 84 is returned to such a degree as to strike on the circumferential surface of the toner housing container 38, so the lever 84 can come into contact with the circumferential surface and give vibration to the circumferential surface. Hence, the lever 84 employs ABS resin or polycarbonate or polystyrene. The thickness of the lever 84 is 10 to 20 mm, preferably about 15 mm. The length from the knocking portion 202 of the lever 84 to the rotational axis (shaft portion 84*a*) of the lever 84 is 150 to 80 mm, preferably about 100 mm. The distance from the circumferential surface to the knocking portion 202 is shorter than the radial length (height) of the protrusion (38K1 and 38K2) of the toner housing container 38. Of course, the lever 84 may be formed from a non-elastic or non-flexible member and the toner housing container 38 itself may be formed from an elastic or flexible member. That is, even if the protrusions 38K1 and 38K2 were elastically deformed with respect to the lever 84, similar advantages would be obtainable. However, in the case where both the lever 84 and the toner housing container 38 are not formed from an elastic or flexible member, the knocking portion of the lever 84 has to be arranged in close proximity (non-contact) to the circumferential surface of the toner housing container 38.

Figure 32:
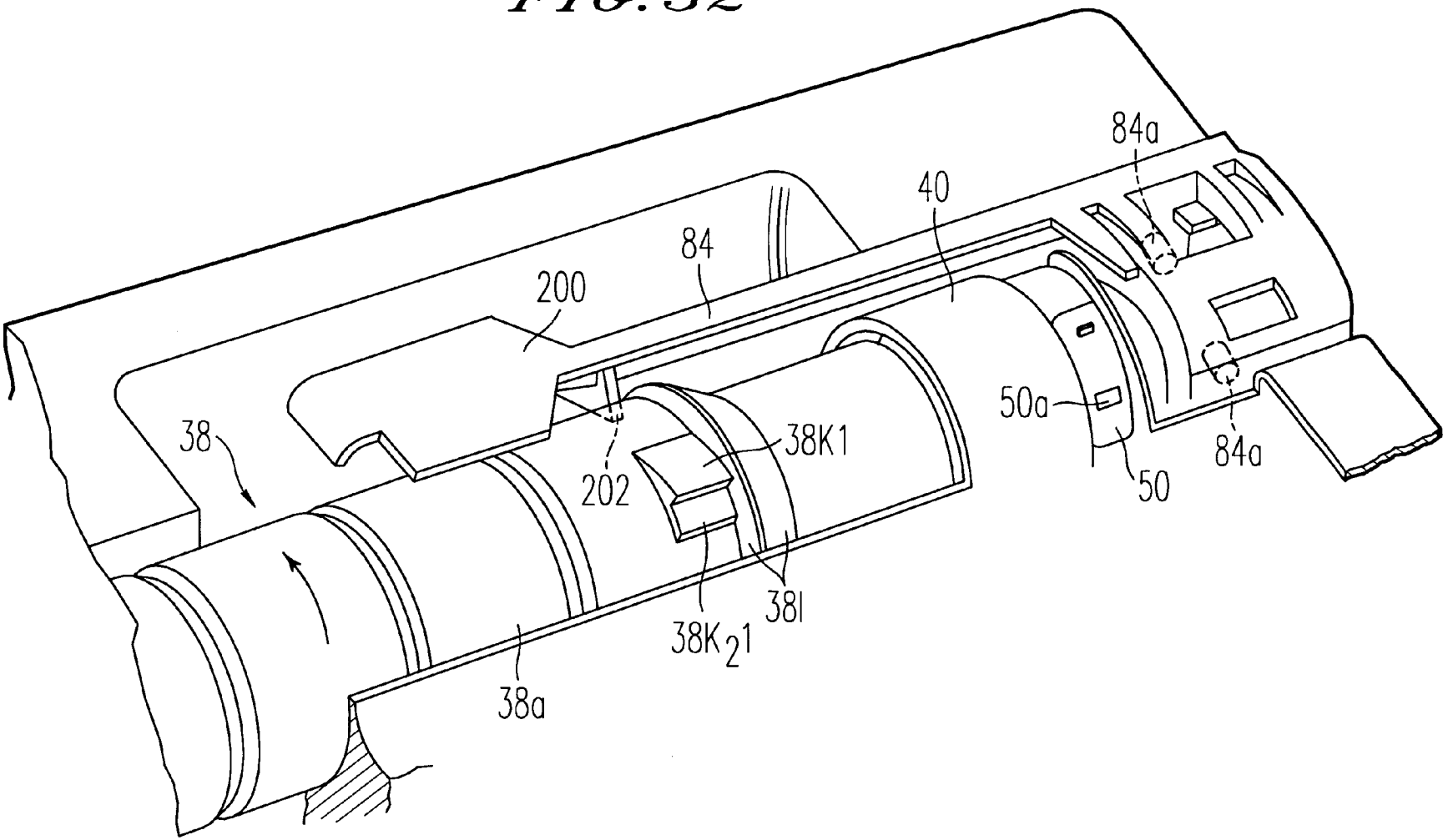
FIG. 32 is a perspective view showing a variation of the second embodiment, the toner housing container having been loaded into the toner supply unit.
Figure 33A:
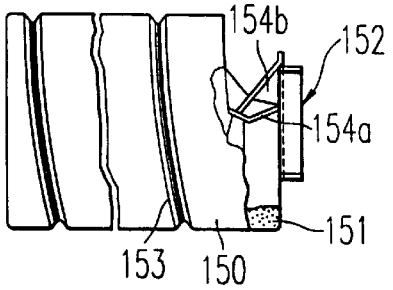
FIGS. 33(*a*) through (*d*) and FIGS. 33(*a'*) trough (*d'*) are front and side views showing how toner is discharged from a toner housing container.
Figure 33A:
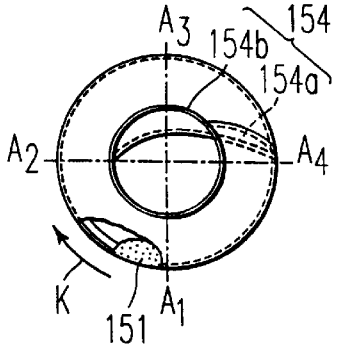
Figure 33B:
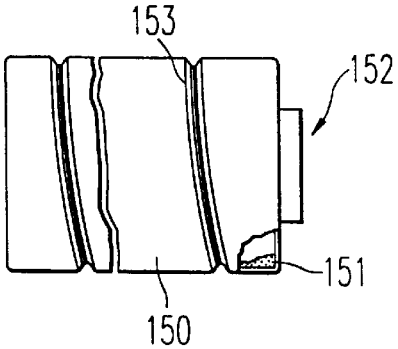
Figure 33B:
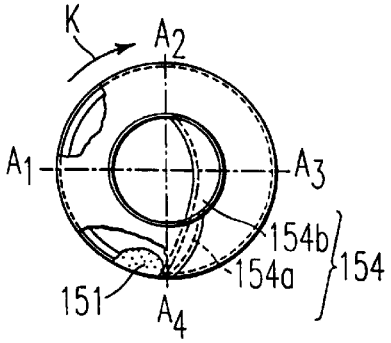
Figure 33C:
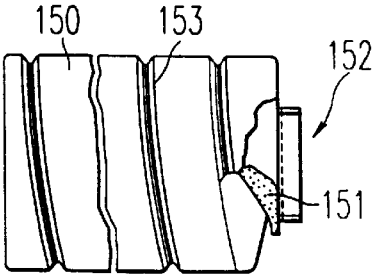
Figure 33C:
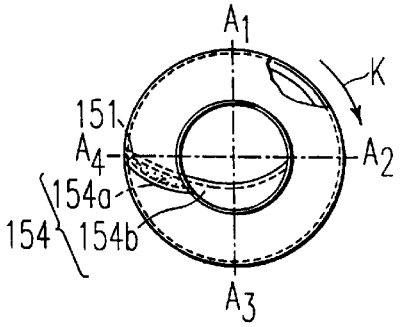
Figure 33D:
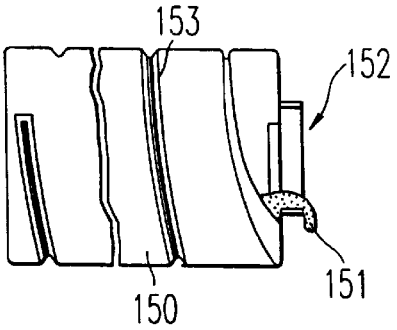
Figure 33D:
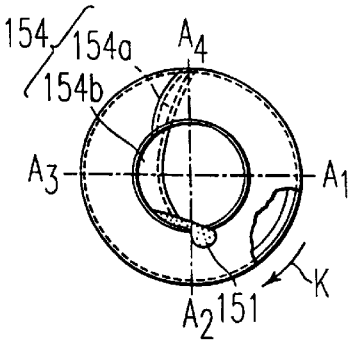

However, even if the knocking portion 202 were in close proximity (non-contact) to the toner housing container 38, they would still be in a spaced state. Therefore, after the knocking portion 202 has rode across each of the protrusions 38K1 and 38K2, it is difficult to knock the toner housing container 38 with the knocking portion 202. The surface (hereinafter referred to as a collision surface, because it is a surface which is knocked by the knocking portion 202) immediately after each protrusion 38K1 or 38K2 is formed so that it is lower than the height of each protrusion and higher than the container main body 38*a*. If done in this way, this collision surface (represented by 38K*a*1 in FIG. 32) can be knocked by the knocking portion 202 immediately after it has rode across each protrusion 38K1 or 38K2.

In the case where the knocking portion 202 slides along the circumferential surface of the toner housing container 38, the influence of the knocking portion 202 on rotation of the toner housing container 38 can also be eliminated by adjusting contact pressure between the sliding surfaces, employing a member with a low frictional coefficient in the sliding surfaces, or applying a lubricating oil. In addition, if the portion of the toner housing container 38 which is knocked by the knocking member 202 is selected so that the wear resisting property is inferior to the knocking member (grip 200) or at least the knocking portion 202, the life of the knocking member can be prolonged. The same is also true of the aforementioned first embodiment.

In the aforementioned embodiment, while the toner housing container 38 has been placed on the receiving bed 42 and fixed by pulling down the lever 84 and also the knocking portion 202 has been provided on the lever 84, the present invention is not limited to this. For example, the toner housing container of the present invention is also applicable to an image forming apparatus such as that disclosed in Japan Laid-Open Patent Publication No. HEI 8-95361. In the image forming apparatus, an elastic stopper fixed to a receiving bed engages the alligator-shaped member of a toner housing container to lock the toner housing container and is provided with a knocking portion.

While the present invention has been described with reference to preferred embodiments thereof, the invention is not to be limited to the details given herein, but may be modified within the scope of the appended claims.

What is claimed is:

1. In an image forming apparatus loaded with a toner housing container which houses toner and has an opening, the image forming apparatus wherein a lower portion of said toner housing container is knocked with rotation of said toner housing container so that toner on an interior wall of said toner housing container is moved.

2. In an image forming apparatus loaded with a toner housing container which houses toner and has an opening, the image forming apparatus wherein a lower portion of said toner housing container is knocked so that toner on an interior wall of said toner housing container is moved, wherein said toner housing container is cylindrical in shape and provided so that it is rotatable and wherein a protrusion engageable with a knocking member is provided on a circumferential surface portion of the cylindrical toner housing container which rotates.

3. The image forming apparatus as set forth in claim 2, wherein said circumferential surface portion and said knocking member are in non-contact with each other, said knocking member has flexibility or elasticity, and said circumferential surface portion and said knocking member contact each other, as said toner housing container is rotated.

4. The image forming apparatus as set forth in claim 2, wherein said circumferential surface portion and said knocking member are in non-contact with each other, said toner housing container has flexibility or elasticity, and said circumferential surface portion and said knocking member contact each other, as said toner housing container is rotated.

5. The image forming apparatus as set forth in claim 2, wherein said protrusion comprises a plurality of protrusions.

6. The image forming apparatus as set forth in claim 5, wherein said plurality of protrusions are different in length in a normal direction from each other.

7. In an image forming apparatus loaded with a toner housing container which houses toner and has an opening, the image forming apparatus wherein a lower portion of said toner housing container is knocked so that toner on an interior wall of said toner housing container is moved, wherein a member for knocking said toner housing container is also a bed for receiving said toner housing container.

8. The image forming apparatus as set forth in claim 7, wherein said toner housing container is cylindrical in shape and provided so that it is rotatable and wherein a protrusion engageable with a knocking member is provided on a circumferential surface portion of the cylindrical toner housing container which rotates.

9. The image forming apparatus as set forth in claim 8, wherein said circumferential surface portion and said knocking member are in non-contact with each other, said knocking member has flexibility or elasticity, and said circumferential surface portion and said knocking member contact each other, as said toner housing container is rotated.

10. The image forming apparatus as set forth in claim 8, wherein said circumferential surface portion and said knocking member are in non-contact with each other, said toner housing container has flexibility or elasticity, and said circumferential surface portion and said knocking member contact each other, as said toner housing container is rotated.

11. The image forming apparatus as set forth in claim 8, wherein said protrusion comprises a plurality of protrusions.

12. The image forming apparatus as set forth in claim 11, wherein said plurality of protrusions are different in length in a normal direction from each other.

13. The image forming apparatus as set forth in claim 7, wherein said bed is slidable with respect to a main body by making use of engagement portions and wherein pressing means for pressing said bed is provided so that said bed is pressed in one direction of a gap between said engagement portions.

14. The image forming apparatus as set forth in claim 13, wherein said pressing means presses said bed elastically.

15. In an image forming apparatus loaded with a toner housing container which houses toner and has an opening, the image forming apparatus wherein said toner housing container is knocked with rotation of said toner housing container with a portion having a long surface in a direction in which toner in said toner housing container is moved, in such a manner that toner on an interior wall of said toner housing container is moved.

16. In an image forming apparatus loaded with a toner housing container which houses toner and has an opening, the image forming apparatus wherein said toner housing container is knocked with a portion having a long surface in a direction in which toner in said toner housing container is moved, in such a manner that toner on an interior wall of said toner housing container is moved, wherein said toner housing container is cylindrical in shape and provided so that it is rotatable and wherein a protrusion engageable with a knocking member is provided on a circumferential surface portion of the cylindrical toner housing container which rotates.

17. The image forming apparatus as set forth in claim 16, wherein said circumferential surface portion and said knocking member are in non-contact with each other, said knocking member has flexibility or elasticity, and said circumferential surface portion and said knocking member contact each other, as said toner housing container is rotated.

18. The image forming apparatus as set forth in claim 16, wherein said circumferential surface portion and said knocking member are in non-contact with each other, said toner housing container has flexibility or elasticity, and said circumferential surface portion and said knocking member contact each other, as said toner housing container is rotated.

19. The image forming apparatus as set forth in claim 16, wherein said protrusion comprises a plurality of protrusions.

20. The image forming apparatus as set forth in claim 19, wherein said plurality of protrusions are different in length in a normal direction from each other.

21. In an image forming apparatus loaded with a toner housing container which houses toner and has an opening, the image forming apparatus wherein said toner housing container is knocked with a portion having a long surface in a direction in which toner in said toner housing container is moved, in such a manner that toner on an interior wall of said toner housing container is moved, wherein a member for knocking said toner housing container is also a bed for receiving said toner housing container.

22. The image forming apparatus as set forth in claim 21, wherein said toner housing container is cylindrical in shape and provided so that it is rotatable and wherein a protrusion engageable with a knocking member is provided on a circumferential surface portion of the cylindrical toner housing container which rotates.

23. The image forming apparatus as set forth in claim 22, wherein said circumferential surface portion and said knocking member are in non-contact with each other, said knocking member has flexibility or elasticity, and said circumferential surface portion and said knocking member contact each other, as said toner housing container is rotated.

24. The image forming apparatus as set forth in claim 22, wherein said circumferential surface portion and said knocking member are in non-contact with each other, said toner housing container has flexibility or elasticity, and said circumferential surface portion and said knocking member contact each other, as said toner housing container is rotated.

25. The image forming apparatus as set forth in claim 22, wherein said protrusion comprises a plurality of protrusions.

26. The image forming apparatus as set forth in claim 25, wherein said plurality of protrusions are different in length in a normal direction from each other.

27. The image forming apparatus as set forth in claim 21, wherein said bed is slidable with respect to a main body by making use of engagement portions and wherein means for pressing said bed is provided so that said bed is pressed in one direction of a gap between said engagement portions.

28. The image forming apparatus as set forth in claim 27, wherein said pressing means presses said bed elastically.

29. In an image forming apparatus loaded with a toner housing container which houses toner and has an opening, the image forming apparatus wherein said toner housing container is knocked at two points so that toner on an interior wall of said toner housing container is moved.

30. The image forming apparatus as set forth in claim 29, wherein said toner housing container is cylindrical in shape and provided so that it is rotatable and wherein a protrusion engageable with a knocking member is provided on a circumferential surface portion of the cylindrical toner housing container which rotates.

31. The image forming apparatus as set forth in claim 30, wherein said circumferential surface portion and said knocking member are in non-contact with each other, said knocking member has flexibility or elasticity, and said circumferential surface portion and said knocking member contact each other, as said toner housing container is rotated.

32. The image forming apparatus as set forth in claim 30, wherein said circumferential surface portion and said knocking member are in non-contact with each other, said toner housing container has flexibility or elasticity, and said circumferential surface portion and said knocking member contact each other, as said toner housing container is rotated.

33. The image forming apparatus as set forth in claim 30, wherein said protrusion comprises a plurality of protrusions.

34. The image forming apparatus as set forth in claim 33, wherein said plurality of protrusions are different in length in a normal direction from each other.

35. The image forming apparatus as set forth in claim 29, wherein a member for knocking said toner housing container is also a bed for receiving said toner housing container.

36. The image forming apparatus as set forth in claim 35, wherein said toner housing container is cylindrical in shape and provided so that it is rotatable and wherein a protrusion engageable with a knocking member is provided on a circumferential surface portion of the cylindrical toner housing container which rotates.

37. The image forming apparatus as set forth in claim 36, wherein said circumferential surface portion and said knocking member are in non-contact with each other, said knocking member has flexibility or elasticity, and said circumferential surface portion and said knocking member contact each other, as said toner housing container is rotated.

38. The image forming apparatus as set forth in claim 36, wherein said circumferential surface portion and said knocking member are in non-contact with each other, said toner housing container has flexibility or elasticity, and said circumferential surface portion and said knocking member contact each other, as said toner housing container is rotated.

39. The image forming apparatus as set forth in claim 36, wherein said protrusion comprises a plurality of protrusions.

40. The image forming apparatus as set forth in claim 39, wherein said plurality of protrusions are different in length in a normal direction from each other.

41. The image forming apparatus as set forth in claim 35, wherein said bed is slidable with respect to a main body by making use of engagement portions and wherein means for pressing said bed is provided so that said bed is pressed in one direction of a gap between said engagement portions.

42. The image forming apparatus as set forth in claim 41, wherein said pressing means presses said bed elastically.

43. In an image forming apparatus loaded with a toner housing container which houses toner and has an opening, the image forming apparatus wherein a member for knocking said toner housing container comprises material superior in wear-resisting property to said toner housing container and wherein said toner housing container is knocked with the knocking member with rotation of said toner housing container so that toner on an interior wall of said toner housing container is moved.

44. In an image forming apparatus loaded with a toner housing container which houses toner and has an opening, the image forming apparatus wherein a member for knocking said toner housing container comprises material superior in wear-resisting property to said toner housing container and wherein said toner housing container is knocked with the knocking member so that toner on an interior wall of said toner housing container is moved, wherein said toner housing container is cylindrical in shape and provided so that it is rotatable and wherein a protrusion engageable with said knocking member is provided on a circumferential surface portion of the cylindrical toner housing container which rotates.

45. The image forming apparatus as set forth in claim 44, wherein said circumferential surface portion and said knocking member are in non-contact with each other, said knocking member has flexibility or elasticity, and said circumferential surface portion and said knocking member contact each other, as said toner housing container is rotated.

46. The image forming apparatus as set forth in claim 44, wherein said circumferential surface portion and said knocking member are in non-contact with each other, said toner housing container has flexibility or elasticity, and said circumferential surface portion and said knocking member contact each other, as said toner housing container is rotated.

47. The image forming apparatus as set forth in claim 44, wherein said protrusion comprises a plurality of protrusions.

48. The image forming apparatus as set forth in claim 47, wherein said plurality of protrusions are different in length in a normal direction from each other.

49. In an image forming apparatus loaded with a toner housing container which houses toner and has an opening, the image forming apparatus wherein a member for knocking said toner housing container comprises material superior in wear-resisting property to said toner housing container and wherein said toner housing container is knocked with the knocking member so that toner on an interior wall of said toner housing container is moved, wherein said knocking member is exchangeable.

50. The image forming apparatus as set forth in claim 49, wherein said toner housing container is cylindrical in shape and provided so that it is rotatable and wherein a protrusion engageable with said knocking member is provided on a circumferential surface portion of the cylindrical toner housing container which rotates.

51. The image forming apparatus as set forth in claim 50, wherein said circumferential surface portion and said knocking member are in non-contact with each other, said knocking member has flexibility or elasticity, and said circumferential surface portion and said knocking member contact each other, as said toner housing container is rotated.

52. The image forming apparatus as set forth in claim 50, wherein said circumferential surface portion and said knocking member are in non-contact with each other, said toner housing container has flexibility or elasticity, and said circumferential surface portion and said knocking member contact each other, as said toner housing container is rotated.

53. The image forming apparatus as set forth in claim 50, wherein said protrusion comprises a plurality of protrusions.

54. The image forming apparatus as set forth in claim 53, wherein said plurality of protrusions are different in length in a normal direction from each other.

55. In an image forming apparatus loaded with a toner housing container which houses toner and has an opening, the image forming apparatus wherein a member for knocking said toner housing container comprises material superior in wear-resisting property to said toner housing container and wherein said toner housing container is knocked with the knocking member so that toner on an interior wall of said toner housing container is moved, wherein said knocking member is also a bed for receiving said toner housing container.

56. The image forming apparatus as set forth in claim 55, wherein said toner housing container is cylindrical in shape and provided so that it is rotatable and wherein a protrusion engageable with said knocking member is provided on a circumferential surface portion of the cylindrical toner housing container which rotates.

57. The image forming apparatus as set forth in claim 56, wherein said circumferential surface portion and said knocking member are in non-contact with each other, said knocking member has flexibility or elasticity, and said circumferential surface portion and said knocking member contact each other, as said toner housing container is rotated.

58. The image forming apparatus as set forth in claim 56, wherein said circumferential surface portion and said knocking member are in non-contact with each other, said toner housing container has flexibility or elasticity, and said circumferential surface portion and said knocking member contact each other, as said toner housing container is rotated.

59. The image forming apparatus as set forth in claim 56, wherein said protrusion comprises a plurality of protrusions.

60. The image forming apparatus as set forth in claim 59, wherein said plurality of protrusions are different in length in a normal direction from each other.

61. The image forming apparatus as set forth in claim 55, wherein said bed is slidable with respect to a main body by making use of engagement portions and wherein means for pressing said bed is provided so that said bed is pressed in one direction of a gap between said engagement portions.

62. The image forming apparatus as set forth in claim 61, wherein said pressing means presses said bed elastically.

63. In an image forming apparatus loaded with a toner housing container which houses toner and has an opening, the image forming apparatus wherein said toner housing container is knocked with a lever for opening or closing said opening, in such a manner that toner on an interior wall of said toner housing container is moved.

64. The image forming apparatus as set forth in claim 63, wherein said toner housing container is cylindrical in shape and provided so that it is rotatable and wherein a protrusion engageable with a knocking member is provided on a circumferential surface portion of the cylindrical toner housing container which rotates.

65. The image forming apparatus as set forth in claim 64, wherein said circumferential surface portion and said knocking member are in non-contact with each other, said knocking member has flexibility or elasticity, and said circumferential surface portion and said knocking member contact each other, as said toner housing container is rotated.

66. The image forming apparatus as set forth in claim 64, wherein said circumferential surface portion and said knocking member are in non-contact with each other, said toner housing container has flexibility or elasticity, and said circumferential surface portion and said knocking member contact each other, as said toner housing container is rotated.

67. The image forming apparatus as set forth in claim 64, wherein said protrusion comprises a plurality of protrusions.

68. The image forming apparatus as set forth in claim 67, wherein said plurality of protrusions are different in length in a normal direction from each other.

69. In an image forming apparatus loaded with a toner housing container which houses toner and has an opening, the image forming apparatus wherein said toner housing container is cylindrical in shape and wherein a circumferential surface of said toner housing container other than circumferential surfaces in horizontal and vertical directions is knocked with a lever so that toner on an interior wall of said toner housing container is moved.

70. The image forming apparatus as set forth in claim 69, wherein said toner housing container is provided so that it is rotatable and wherein a protrusion engageable with a knocking member is provided on a circumferential surface portion of the cylindrical toner housing container which rotates.

71. The image forming apparatus as set forth in claim 70, wherein said circumferential surface portion and said knocking member are in non-contact with each other, said knocking member has flexibility or elasticity, and said circumferential surface portion and said knocking member contact each other, as said toner housing container is rotated.

72. The image forming apparatus as set forth in claim 70, wherein said circumferential surface portion and said knocking member are in non-contact with each other, said toner housing container has flexibility or elasticity, and said circumferential surface portion and said knocking member contact each other, as said toner housing container is rotated.

73. The image forming apparatus as set forth in claim 70, wherein said protrusion comprises a plurality of protrusions.

74. The image forming apparatus as set forth in claim 73, wherein said plurality of protrusions are different in length in a normal direction from each other.

75. In a toner housing container with an opening, the toner housing container which has a lower portion that is knocked with rotation of said toner housing container and wherein said lower portion is knocked so that toner on an interior wall of said toner housing container is moved.

76. In a toner housing container with an opening, the toner housing container which has a portion with a long surface in a direction in which toner in said toner housing container is moved and wherein said portion is knocked with rotation of said toner housing container so that toner on an interior wall of said toner housing container is moved.

77. In a toner housing container with an opening, the toner housing container which has two portions that are knocked and wherein said two portions are knocked so that toner on an interior wall of said toner housing container is moved.

78. In a toner housing container with an opening, the toner housing container which has a portion that is knocked and wherein said portion is inferior in wear-resisting property to a knocking member and knocked so that toner on an interior wall of said toner housing container is moved.

79. In a toner housing container with an opening, the toner housing container which has a portion that is knocked by a lever for opening or closing said opening and wherein said portion is knocked with said lever so that toner on an interior wall of said toner housing container is moved.

80. In a toner housing container with an opening, the toner housing container which is cylindrical in shape and has a portion that is knocked at a circumferential surface other than circumferential surfaces in horizontal and vertical directions and wherein said portion is knocked so that toner on an interior wall of said toner housing container is moved.

* * * * *